US006028030A

United States Patent [19]

Nakano et al.

[11] Patent Number: 6,028,030

[45] Date of Patent: Feb. 22, 2000

[54] THERMAL SENSITIVE RECORDING MEDIUM

[75] Inventors: Tomoyuki Nakano; Koichi Yanai; Junko Seki; Reiji Ohashi; Hidetoshi Yoshioka, all of Kita-ku, Japan

[73] Assignee: Nippon Paper Industrie Co., Ltd., Tokyo, Japan

[21] Appl. No.: 09/034,402

[22] Filed: Mar. 4, 1998

[30] Foreign Application Priority Data

| | | | |
|---|---|---|---|
| Mar. 6, 1997 | [JP] | Japan | 9-052133 |
| Aug. 15, 1997 | [JP] | Japan | 9-220530 |

[51] Int. Cl.[7] ..... B41M 5/30

[52] U.S. Cl. ..... 503/209; 503/208; 503/216; 503/225

[58] Field of Search ..... 503/216, 217, 503/208, 209, 225; 427/150–152

[56] References Cited

U.S. PATENT DOCUMENTS

| | | | |
|---|---|---|---|
| 2,181,663 | 11/1939 | Martin | 260/2 |
| 2,973,342 | 2/1961 | Inaba et al. | 260/77.5 |
| 4,243,716 | 1/1981 | Kosaka et al. | 428/327 |
| 5,380,693 | 1/1995 | Goto | 503/200 |

FOREIGN PATENT DOCUMENTS

| | | | |
|---|---|---|---|
| 0436390 | 7/1991 | European Pat. Off. | 503/214 |
| 0748698 | 12/1996 | European Pat. Off. | 503/207 |
| 63-22683 | 1/1988 | Japan | 503/216 |
| 2-26874 | 1/1990 | Japan | 428/323 |
| 2-39994 | 2/1990 | Japan | 503/227 |
| 4-97887 | 3/1992 | Japan | 503/209 |
| 4113888 | 4/1992 | Japan | 503/209 |
| 4303682 | 10/1992 | Japan | 503/216 |
| 6-32054 | 2/1994 | Japan | 503/216 |
| 8072406 | 3/1996 | Japan | 503/209 |
| 8258430 | 10/1996 | Japan | 503/209 |
| 8349482 | 12/1996 | Japan | 503/216 |
| 9142025 | 6/1997 | Japan | 503/204 |
| 528437 | 5/1939 | United Kingdom . | |
| 2007858 | 5/1979 | United Kingdom | 503/209 |

OTHER PUBLICATIONS

E.L. Lawton et al., Appl. Polym. Sci., 25, 287 (1980), No Month.

C.S. Marvel, et al, J. Am. Chem. Soc., 72, 1674 (1950), No Month.

P. Borner et al., Makromol, Chem., 101, 1(1967), No Month.

L. Alexandru et al., J. Polym.Sci., 52, 331(1961), No Month.

J. Falbe et al, "Rompp Chemie Lexikon", 1990, Georg Thieme Verlag vol. 3, p. 1731—p. 1732, No Month.

Database WPI, Sec. Ch, Week 9621, Derwent Pub., London, GB & JP 08 072 406 abstract, No Month.

N. Yamazaki et al., J. Polym. Sci., Polym. Part C., 12, 517(1974).

G.J.M. Van d, Kerk, Recuil. Trav. Chim., 74, 1301(1955).

R.D. Katsarava et al., Makromal, Chem., 194, 3209 (1993).

W.R. Sorensen, J. Org. Chem., 24, 978 (1993).

*Primary Examiner*—Bruce Hess

[57] ABSTRACT

A thermal sensitive recording medium which further contains poly urea compound in the thermal color developing layer containing dye precursor and color developer, which displays an excellent image preservative stability. Said poly urea compound contains units of a structure represented by general formula (1), and further contains a repeating unit represented by general formulae (2)~(7).

(1)

(2)

(3)

(4)

(5)

(6)

(7)

In these formulae $A^1$~$A^7$ are a divalent group, $R^1$~$R^5$ are an alkyl group, an alkoxy group or an electron accepting group, o, p, and q are an integer from 0 to 4, r is an integer from 2 to 12 and s and t are an integer from 0 to 8.

8 Claims, No Drawings

THERMAL SENSITIVE RECORDING MEDIUM

BACKGROUND OF THE INVENTION

This invention relates to the thermal sensitive recording medium containing poly urea compound in a color developing layer. The preservative stability of a recorded image is superior to that of conventional thermal sensitive recording medium, and is suited to an use to which a long term preservative stability is required.

DESCRIPTION OF THE PRIOR ART

In general, a thermal sensitive recording medium is prepared by following procedure. A colorless or pale colored dye precursor which is ordinarily an electron donating compound and a color developer which is an electron accepting compound are separately ground to fine particles and dispersed, then mixed together. A binder, a filler, a sensitizer, a lubricant and other stabilizers are added, and the obtained coating fluid is coated on a substrate such as paper, synthetic paper, film or plastics, which develops a color by an instantaneous chemical reaction caused by heating with a thermal sensitive head, a hot stamp or a laser beam. These thermal sensitive recording media are widely used to a measuring recorder, a thermal printer of computer, a facsimile, an automatic ticket vender or a bar cord label.

However, recently, along with a diversification of recording apparatuses for thermal sensitive recording medium and a remarkable progress toward high quality, the required quality to the thermal sensitive recording medium are becoming more higher. Further, since the recording method on a normal paper such as an electro photographic method or an ink jet method are becoming more popular, the thermal sensitive recording method is often compared with mentioned normal paper recording method. Therefore, for the thermal sensitive recording method, it is strongly required to improve the stability of recorded part (image) and the stability of not recorded part before and after recorded (ground part or blank part) to the similar quality level of that of normal paper recording method. Especially, from the view point of image preservative stability of a recorded part, the thermal sensitive recording medium which is superior in a light resistance, an oil resistance, a water resistance and a plasticizer resistance is required.

To dissolve the above mentioned problems, methods to contain various kind of stabilizers in a color developing layer are provided. For instance, metallic salts disclosed in Japanese patent laid open publication 63-22683, metallic salts of phospholic ester disclosed in Japanese patent laid open publication 4-303682, metallic salts of benzoic acid derivatives disclosed in Japanese Patent publication 2-26874 or Japanese Patent Publication 2-39994 can be mentioned. In these prior arts, the image preserving effect is expected by containing above mentioned chemicals in a color developing layer. Further, an epoxy compound disclosed in Japanese Patent Laid open Publication 4-97887 and an aziridine compound disclosed in Japanese Patent Laid open Publication 4-113888 display good effect for the improvement of oil resistance and water resistance, and an aliphatic dicarboxylic acid compound disclosed in Japanese Patent Laid open Publication 6-32054 is effective for the improvement of oil resistance. An acylacetanilide compound disclosed in Japanese Patent Laid open Publication 8-72406 and p-hydroxybenzoic acid anilide disclosed in Japanese Patent Laid open Publication 8-258430 have also good effect to an oil resistance.

Among the above mentioned stabilizers, a stabilizer which uses metallic salt has a good effect for the preservative stability of image, however, since it has a problem that the heat resistance of ground color is not good, such stabilizer is difficult to be used practically. In a case of non metallic salt compound, there are not so many stabilizers which are good not only at an oil resistance and a water resistance but also at a plasticizer resistance, therefore it is necessary to use plural kind of stabilizers simultaneously. The method to add plural kind of stabilizers together with and to improve a preservative stability of image for all items has many problems from the view point of productivity and economic and is also practically difficult to be put to the industrial use. For the practical industrial use, one stabilizer compound which is superior at an image preservative stability for whole items such as oil resistance, plasticizer resistance and water resistance.

OBJECT OF THE INVENTION

The object of this invention is to provide a thermal sensitive recording medium whose image preservative stability of recording portion especially such as plasticizer resistance, an oil resistance and a water resistance are improved and whose price is cheap.

BRIEF SUMMARY OF THE INVENTION

The inventors of the present invention have conduced an intensive study and have found that the thermal sensitive recording medium which further contains poly urea compound in the thermal color developing layer containing dye precursor and color developer displays excellent functions concerning the image preservative stability such as plasticizer resistance, oil resistance and water resistance, and accomplished the present invention. That is, the feature of this invention is to use a poly urea compound as a component of the stabilizer.

A poly urea compound which has structures represented by general formula (1) is effectively used in this invention.

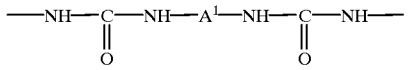

(1)

(in general formula (1), $A^1$ represents divalent group)

Further, a poly urea compound which has a repeating unit represented by following general formulae from (2) to (7) is more useful compound.

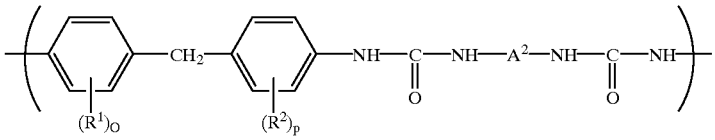

(2)

(in general formula (2), $R^1$ and $R^2$ represent an alkyl group, an alkoxy group or an electron accepting group, o and p represent an integer from 0 to 4, and $A^2$ represents divalent group)

(3)

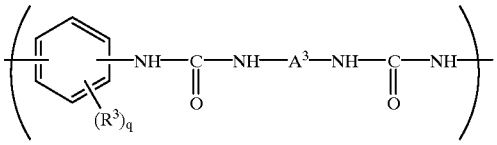

(in general formula (3), $R^3$ represents an alkyl group, an alkoxy group or an electron accepting group, q is an integer from 0 to 4 and $A^3$ represents a divalent group)

(4)

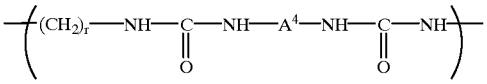

(in general formula (4), r is an intenger from 2 to 12, and $A^4$ represents a divalent group)

(5)

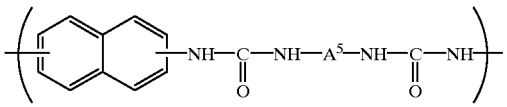

(in general formula (5), $A^5$ represents a divalent group)

(6)

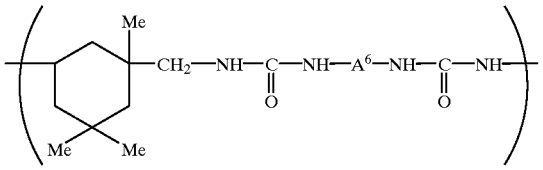

(in general formula (6), $A^6$ represents a divalent group)

(7)

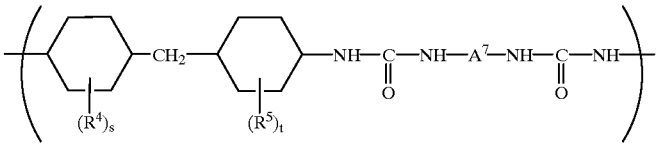

(in general formula (7), $R^4$ and $R^5$ represent an alkyl group, alkoxy group and electron accepting group, s and t are an integer from 0 to 8. $A^5$ represents a divalent group)

Wherein $R^1$–$R^5$ may be a substitution group which does not obstruct the color development and image preservative stability when said compound is used. From this point of view, an alkyl group of carbon number 1 to 4, an alkoxy group of carbon number 1 to 4, and a halogen atom such as chlorine, bromine and fluorine and a nitro group are desirably used as an electron attractive group.

In poly urea component represented in general formulae (1) to (7) of this invention, $A^1$ to $A^7$ respectively represents divalent group. The typical example of group which belongs to $A^1$ to $A^7$ are shown in general formulae (8) and (9), however not intended to be limited to them.

(9)

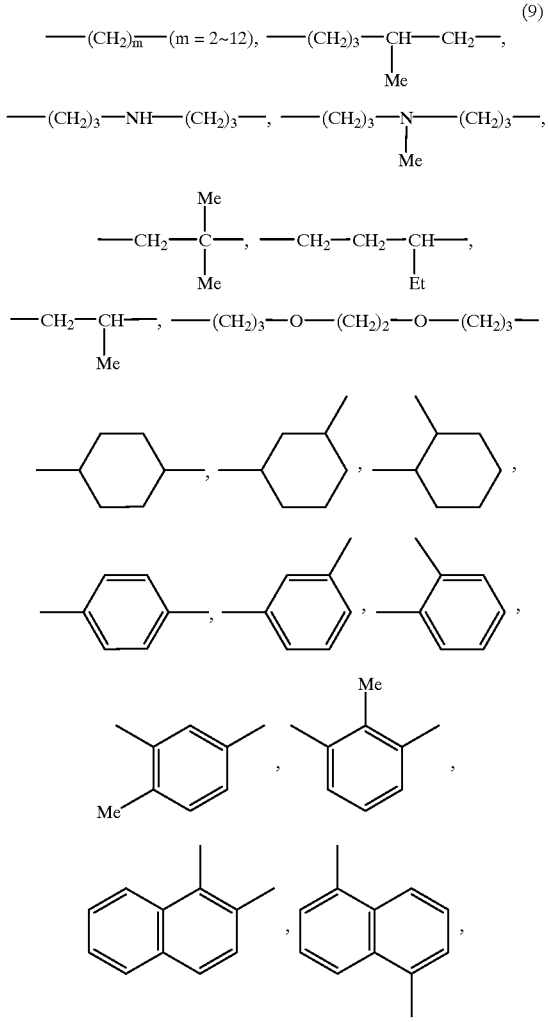

-continued

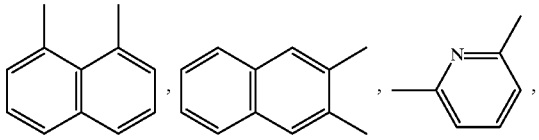

-continued

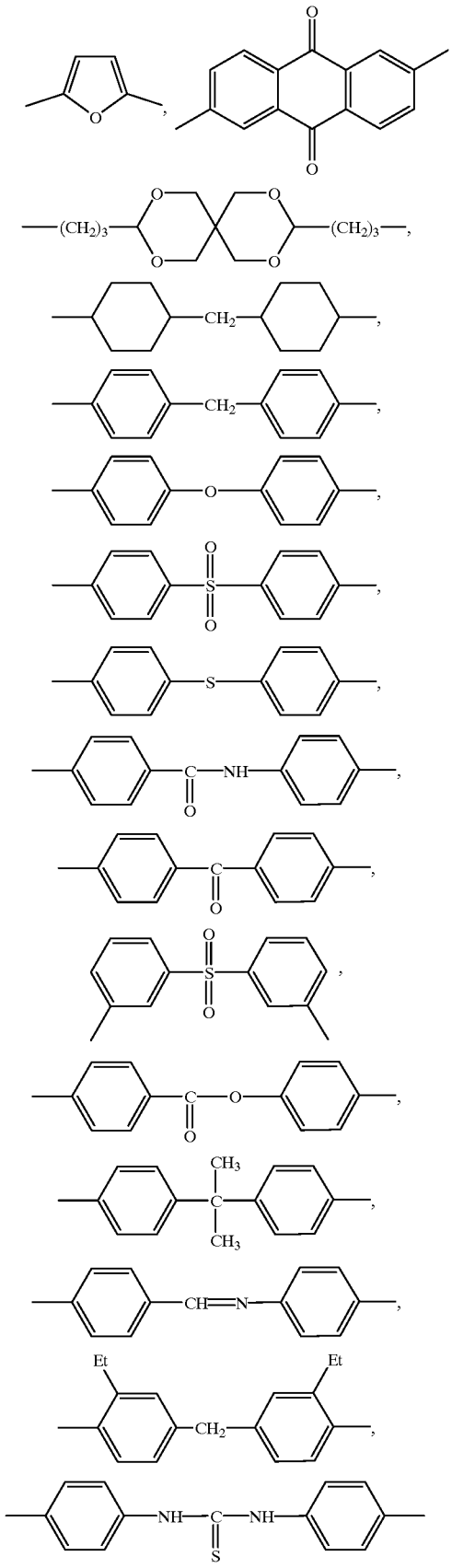

Referring to the poly urea compound having a structure of a-NHCONH-b, there are three cases to combine aromatic or aliphatic hydrocarbon compound with a or b as follows. i) When both a and b are an aliphatic hydrocarbon, electron density on a nitrogen atom of urea becomes bigger because of electron donating feature of aliphatic compound, and a hydrogen atom becomes difficult to be cationated. Therefore, the color developing ability deteriorated and image preservative stability becomes worth. ii) When both a and b are an aromatic hydrocarbon, since the structure of aromatic compound is generally flat and the structural feature of it is stiff, poly urea compound forms easily fibrous or film like. Consequently, at the fabrication of thermal sensitive recording medium, the poly urea compound is mixed with water containing polyvinylalcohol, ground by a pulverizer or an emulsifier such as ball mill, attriter or sand grinder, then poly urea dispersion is prepared. However, in this case, it is very difficult to obtain fine granulated particles and the homogeneously distributed dispersion. Therefore, the image preservative stability is not improved as much as to be expected. iii) When either a or b is an aliphatic compound and another one is an aromatic compound, the color developing ability and the image preservative stability are improved sufficiently and also the dispersion becomes good and the most balanced poly urea can be obtained. Consequently, the divalent groups $A^2$, $A^3$ and $A^5$ of poly urea compounds represented by general formulae (2), (3) and (5) whose one end are bonded with an aromatic hydrocarbon may be aliphatic hydrocarbon, on the contrary the divalent groups $A^4$, $A^6$ and $A^7$ of poly urea compounds represented by general formulae (4), (6) and (7) whose one end are bonded with an aliphatic hydrocarbon may aromatic hydrocarbon be suited.

Especially, as $A^2$, $A^3$ and $A^5$, a normal chain or a partially branched chain hydrocarbon are desirable. And, as $A^4$, $A^6$ and $A^7$, an aromatic hydrocarbon in which hetero atom is not included is suited.

The poly urea compound of this invention has a color developing ability which is reactable with a dye precursor. And the application to use this compound as a color developer is already disclosed in Japanese Patent application 8-349482. Since, poly urea is insoluble in oil, plasticizer or various kind of solvents because it is a compound of high molecular weight, it is not solved by them even if it is exposed to them, and as the result, the vanishing phenomenon of image caused by dissociation with dye is not observed and an excellent image preservative stability can be obtained. The image preservative stability of the poly urea of this invention is remarkably superior to that of conventional color developer such as phenols, low molecular weight urea or urethane, therefore it is especially useful for the application which long term image preservative stability of recorded part is required.

Meanwhile, recently, in addition to the image preservative stability, the requirement to improve a color developing property as to obtain sufficient color density by lower impressive energy is becoming more serious. The inventors of this invention have found that to add poly urea compound to the thermal sensitive recording media which uses conventional well known color developer is effective. When they are used together with, the excellent thermal sensitive recording media which is endowed both good color developing ability of conventional well known color developer, and the color developing function and the image preservative stability can be obtained.

Further, the thermal sensitive recording media of this invention has a strong point that the developed image does not varnish when it is contacted with plasticizer, still further since it does not have problems such as line fading, hazing or blotting, it superior at a fine line image such as a numeral figure or a character.

The amount of poly urea compound of this invention in a color developing layer is changeable accordingly to the required quality, however, when the amount is smaller than 0.01 part to 1 part of a color developer the effect to the image preservative stability is not sufficient, and when the amount is bigger than 2 parts to 1 part of a color developer the initial color developing density is not sufficient. Therefore, the amount of poly urea compound to be contained is 0.01 to 2 parts and desirably smaller than 1 part to 1 part of color developer.

As the substantial examples of compounds of general formula (1) to (7) used in this invention following compounds are mentioned, however not intended to be limited to them. And, these mentioned poly urea compound can be used alone or by mixing together.

(A-01)

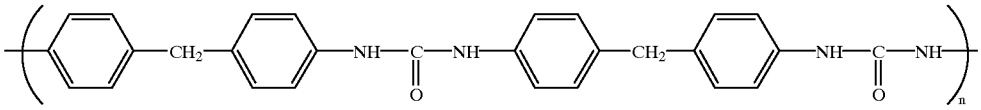

(A-02)

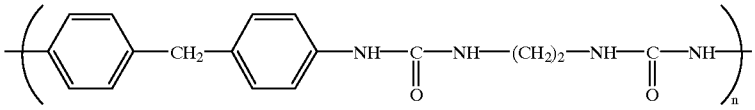

(A-03)

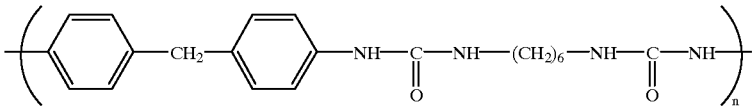

(A-04)

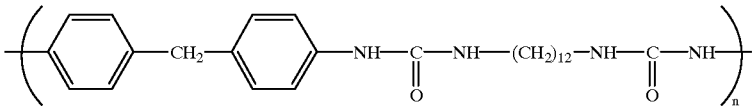

(A-05)

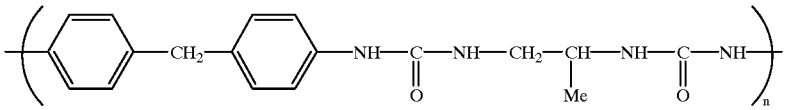

(A-06)

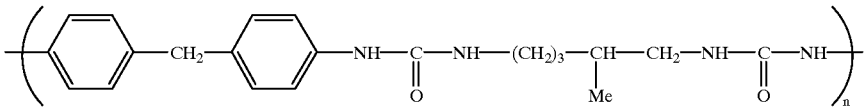

(A-07)

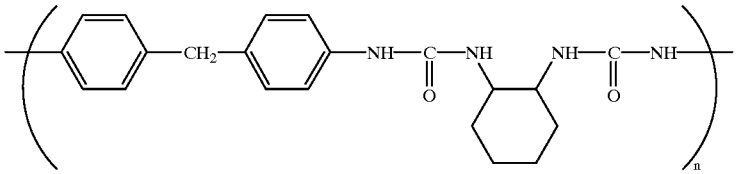

(A-08)

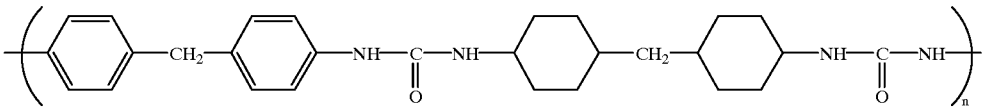

(A-09)

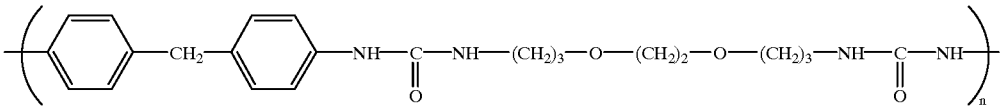

(A-10)

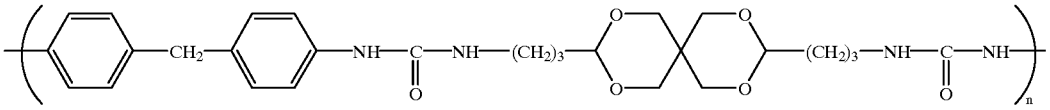

-continued
(A-11)
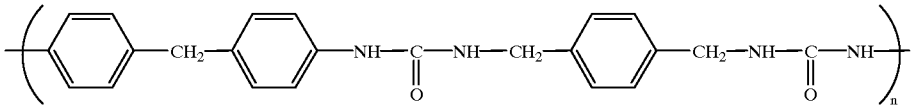
(A-12)
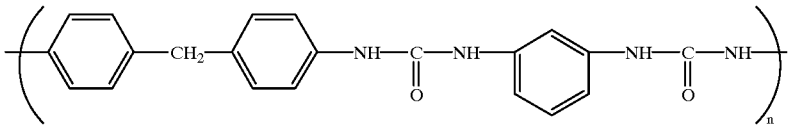
(A-13)
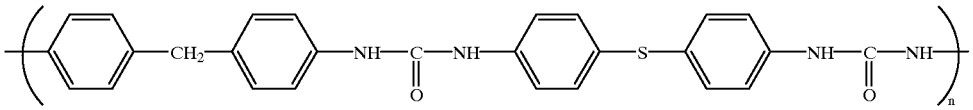
(A-14)
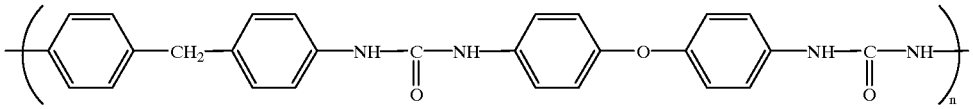
(A-15)
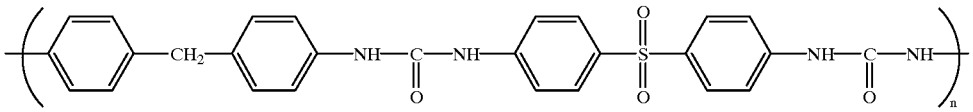
(A-16)
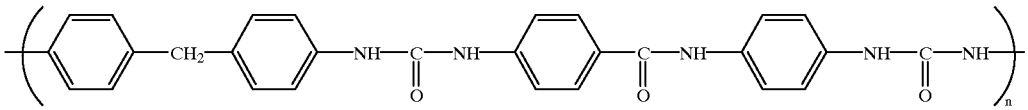
(A-17)
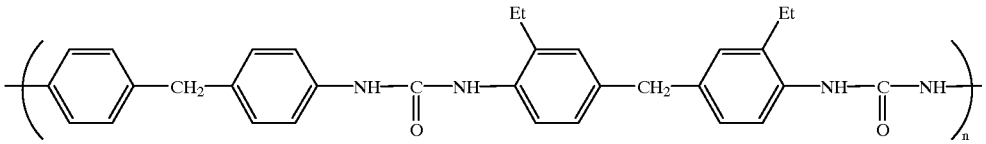
(A-18)
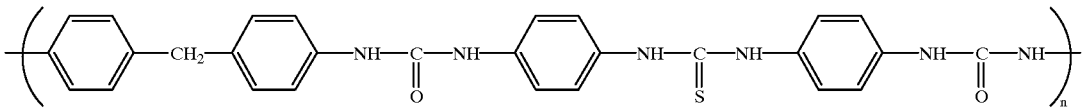
(A-19)
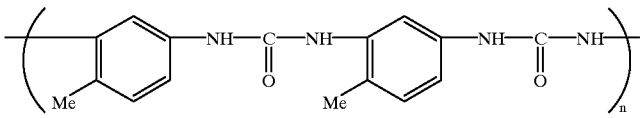
(A-20)
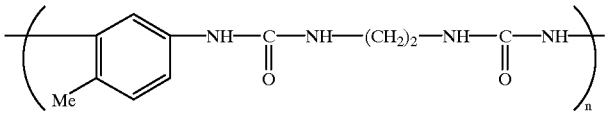
(A-21)
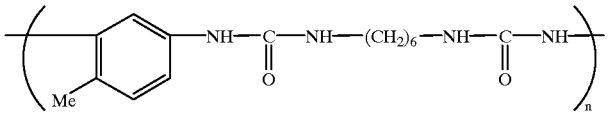

-continued
(A-22)
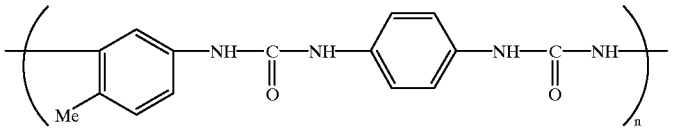
(A-23)
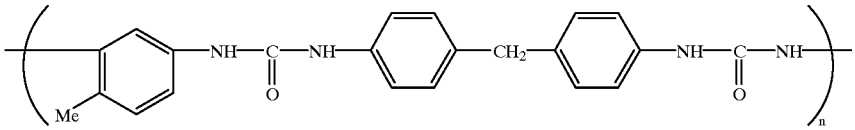
(A-24)
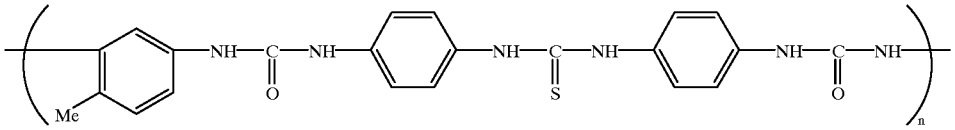
(A-25)
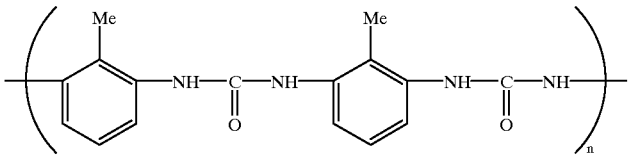
(A-26)
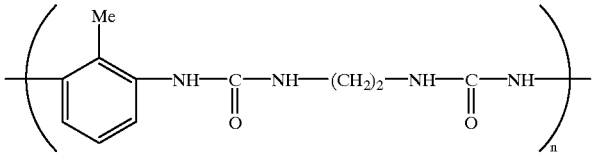
(A-27)
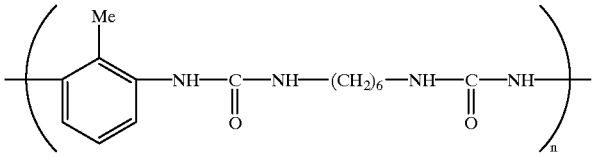
(A-28)
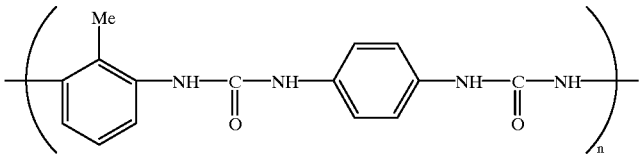
(A-29)
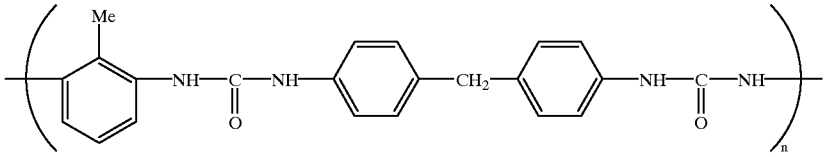
(A-30)
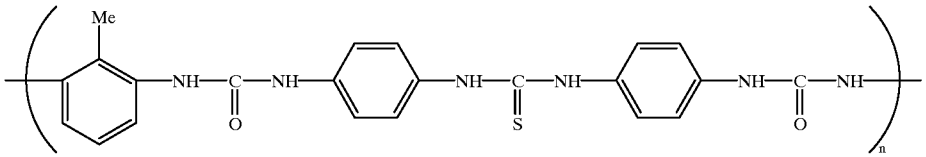

-continued
(A-31)
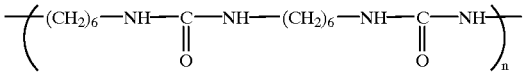
(A-32)
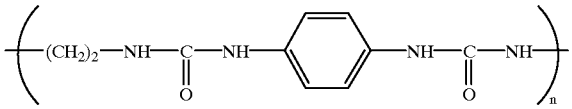
(A-33)
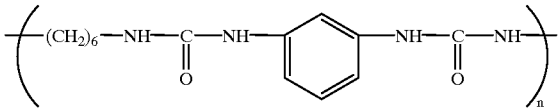
(A-34)
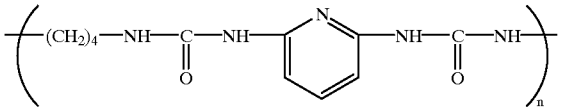
(A-35)
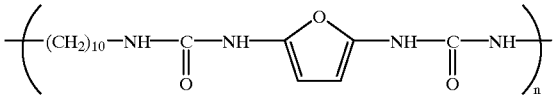
(A-36)
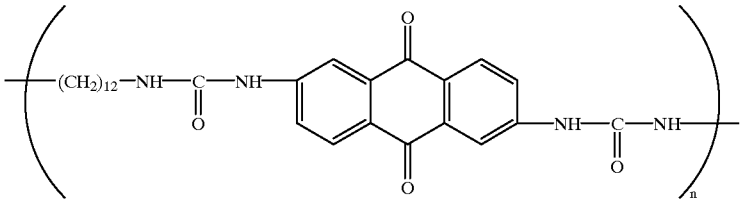
(A-37)
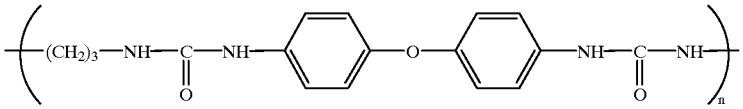
(A-38)
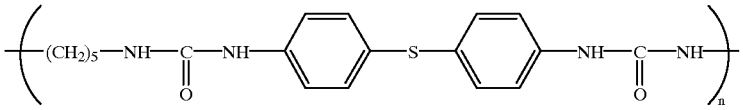
(A-39)
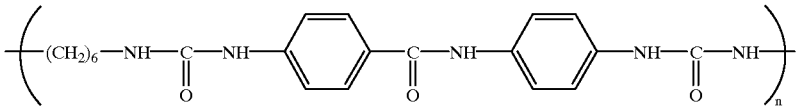
(A-40)
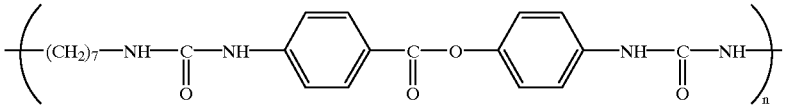
(A-41)
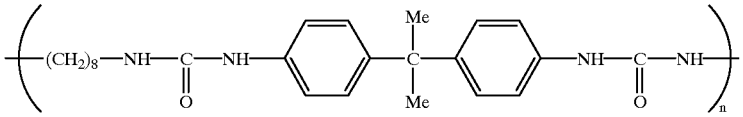

-continued
(A-42)
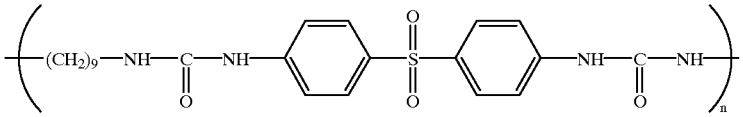
(A-43)
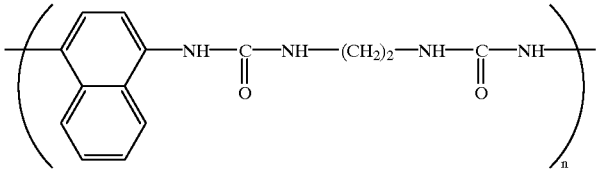
(A-44)
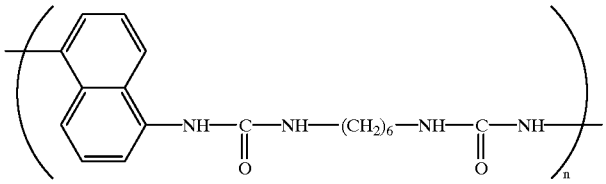
(A-45)
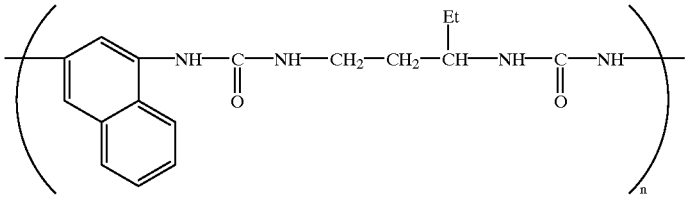
(A-46)
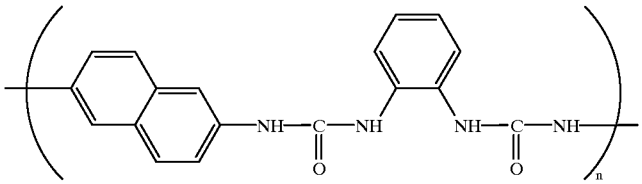
(A-47)
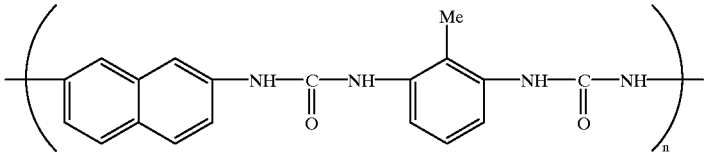
(A-48)
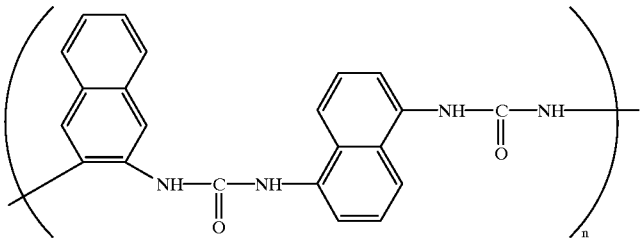
(A-49)
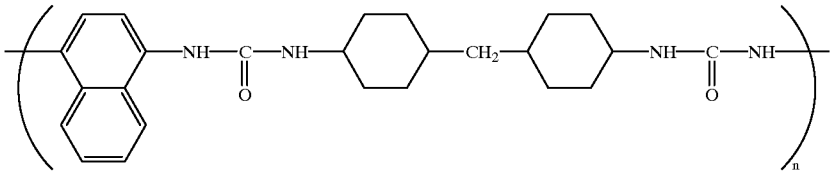

-continued
(A-50)
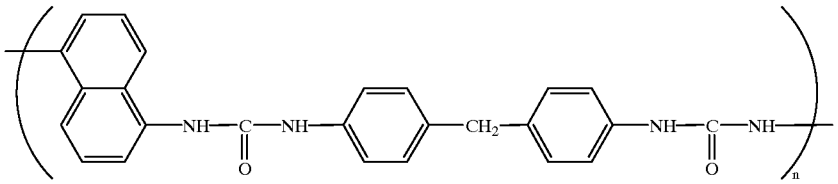
(A-51)
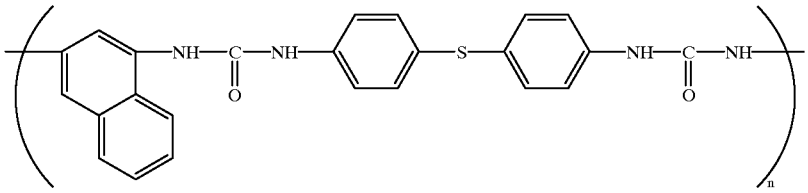
(A-52)
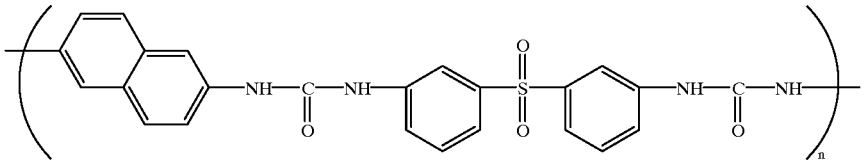
(A-53)
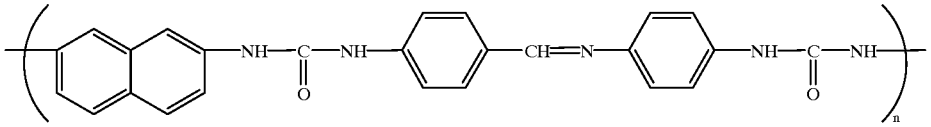
(A-54)
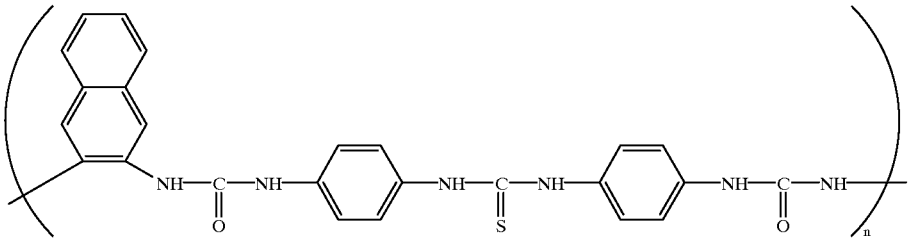
(A-55)
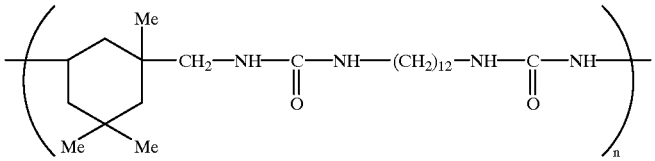
(A-56)
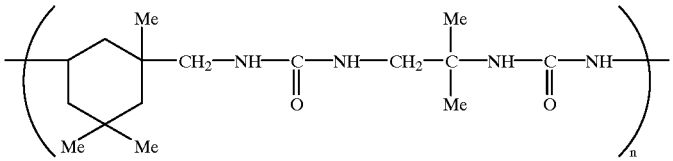
(A-57)
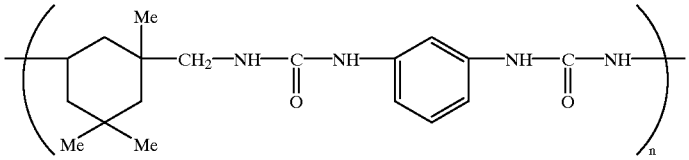

-continued
(A-58)
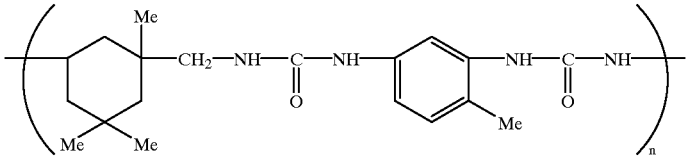
(A-59)
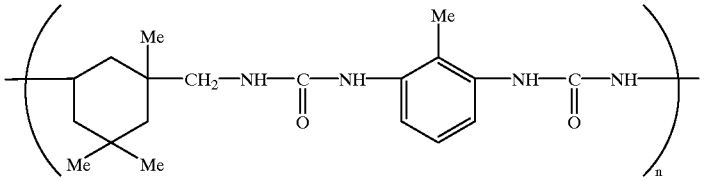
(A-60)
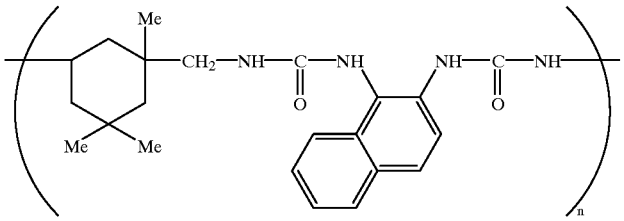
(A-61)
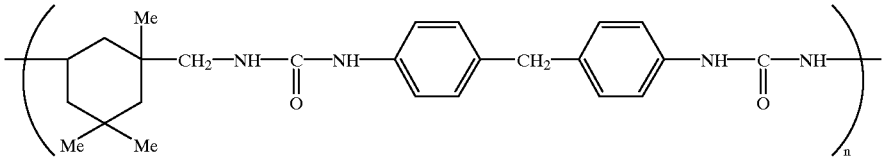
(A-62)
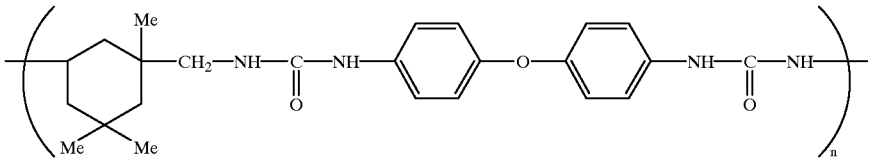
(A-63)
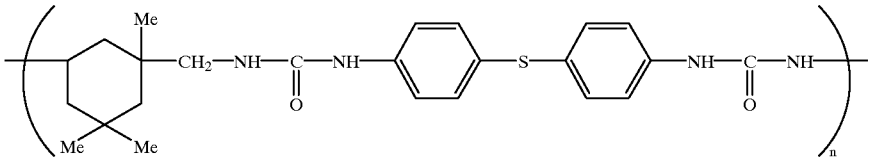
(A-64)
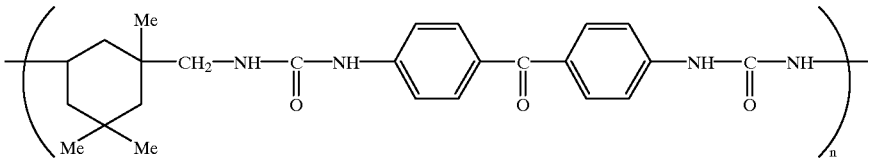
(A-65)
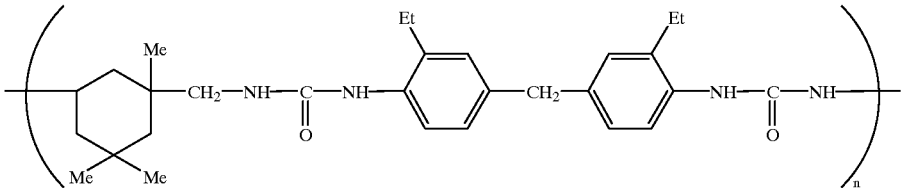

-continued
(A-66)
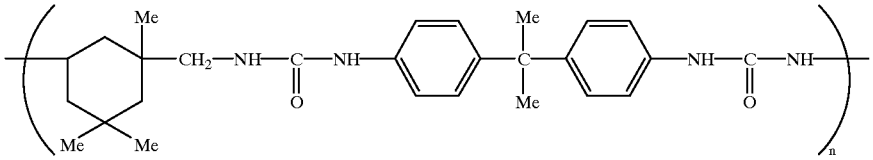
(A-67)
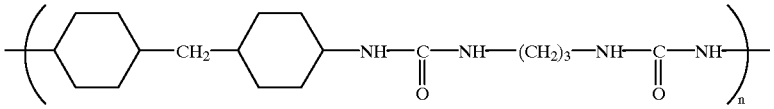
(A-68)
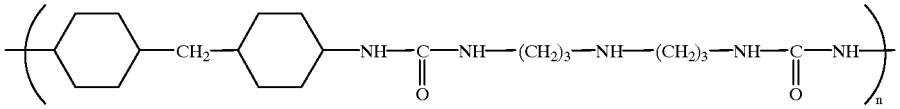
(A-69)
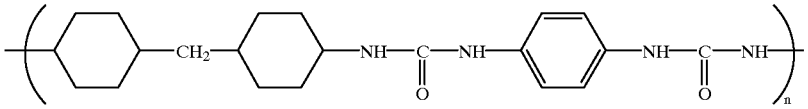
(A-70)
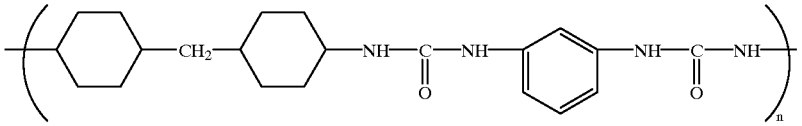
(A-71)
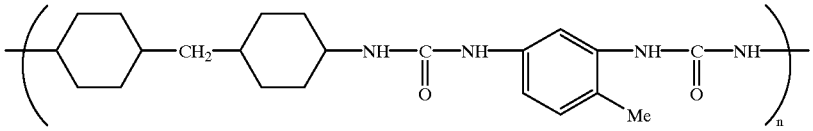
(A-72)
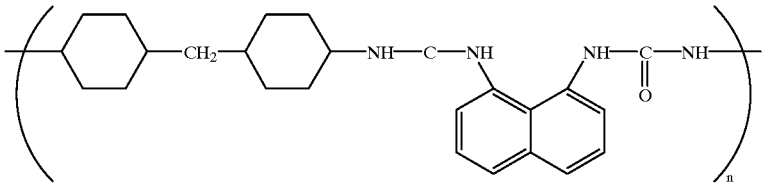
(A-73)
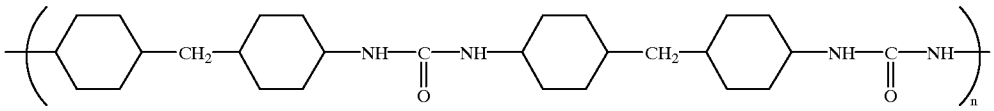
(A-74)
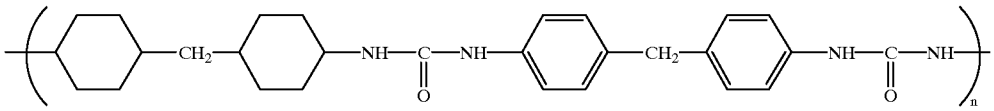
(A-75)
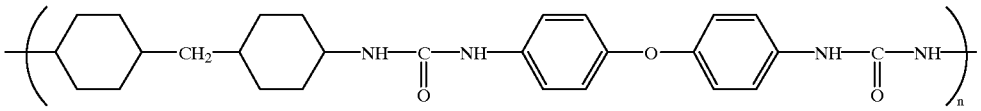

-continued (A-76)

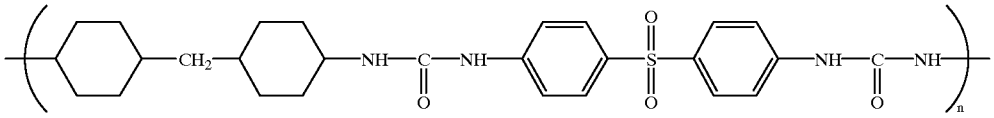

(A-77)

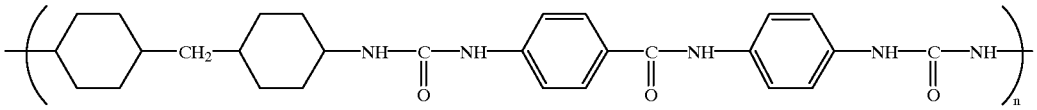

(A-78)

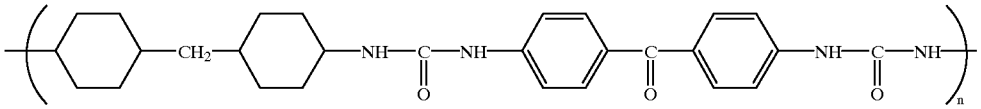

DISCLOSURE OF THE INVENTION

The poly urea compounds of this invention can be synthesized by a conventional well known method. The following methods can be mentioned as the typical conventional well known method.

(a) The method to dissolve diisocyanate and diamine in an inert solvent such as dimethylacetoamide, acetone, dimethylformamide, chlorobenzene or dimethylsulfoxide, mix them in the inert gas atmosphere for several minutes to several hours by constant stirring at the room temperature and react them. [E. L. Lawton et al., Appl. Polym. Sci., 25, 187(1980) or C. S. Marvel, J. H. Johnson, J. Am. Chem. Soc., 12, 1674(1950)]

(b) The synthetic method by mixing diamine with urea and heating, then de-ammonia. [Mitsui Toatsu, U.S. Pat. No. 2,973,342(1961)]

(c) The synthetic method by reaction of diamine and phosgene by way of carbamic acid chloride. [P. Borner et al., Makromol. Chem., 101, 1(1967) or L. Alexandru, L. Dascalu, J. Polym. Sci., 52, 331(1961)]

(d) The synthetic method by heating diamine and carbamate [Brit. Pat., 528437(1940) or U.S. Pat. No. 2,181,663 (1940)]

(e) The synthetic method by heating diamine and carbon dioxide under high pressure. [N. Yamazaki et al., J. Polym. Sci. PartC., 12, 517(1974)]

(f) The synthetic method by heating diamine and carbon oxysulfide under lower pressure. [G. J. M. Van d. Kerk, Recueil. Trav. Chim., 74, 1301 (1955)]

(g) The synthetic method by reacting diamine and diphenyl carbonate or di(p-nitrophenyl) carbonate. [R. D. Katsarava et al., Makromol. Chem., 194, 3209 (1993)]

(h) The synthetic method from diisocyanate and benzoic acid in dimethylsulfoxide. [W. R. Sorensen, J. Org. Chem., 24, 978 (1959)]

In the case of synthetic method using diisocyanate as a starting material, since diphenylmethane-4,4'-diisocyanate <commodity name: MDI>, tolylene-2,4-diisocyanate <2,4-TDI>, tolylene-2,6-diisocyanate <2,6-TDI>, 1,6-hexamethylenediisocyanate <HDI>, 1,5-naphthylenediisocyanate <NDI>, isophorone-diisocyanate and dicyclohexylmethane-4,4'-diisocyanate which can be a starting material, are produced commercially in the market, they can be easily bought by lower price from the market. And for the production of poly urea, they can be synthesized by high productivity without special equipment. Therefore, when the compound of this invention is fabricated using above mentioned compound as a starting material, the production cost becomes very low.

The poly urea compound of from claims 1 to 9 of the present invention can be synthesized by any methods mentioned above, and among them (a) method which synthesize it using diisocyanate is most convenient.

Since the poly urea compound of this invention is insoluble or very difficult to be solved in any kind of solvents, the measurement of molecular weight of the compound is impossible. Therefore, it is very difficult to confirm that these compounds are apparently high molecular compound. However, from the view point that they do not have a constant and sharp melting point and they have a good spinnability which is observed by sticking and pulling up the molten fluid of these compound with a glass bar, further they indicate very high viscosity when they are dissolved in conc sulfuric acid, it is possible to presume that these compounds are high molecular compounds.

For the fabrication of thermal sensitive recording medium of this invention, various kind of conventional well known producing method can be used. Concretely, it can be fabricated by following method. That is, poly urea compound, dye precursor, color developer and sensitizer are ground and granulated by a pulverizer or an emulsifier such as ball mill, attriter or sand grinder, add fillers and additives, then dispersed in aqueous solution of water soluble binder, thus the coating is obtained. And the thermal sensitive recording medium can be obtained by coating the obtained coating on a surface of voluntary substrate by means of an air knife coater, a blade coater or a roll coater.

As the dye precursor to be used to the thermal sensitive recording medium, the conventional well known chemical compounds can be used. The examples of dye precursor used to the thermal sensitive recording medium are listed below, however not intended to be limited to them. These dye precursor can be used alone or used by mixing together.

3,3-bis(4-dimethylaminophenyl)-6-dimethylaminophtalide <commodity name: CVL>, 3-diethylamino-6-methyl-7-anilinofluoran <OBD>, 3-(N-isoamyl-N-ethylamino)-6-methyl-7-anilinofluoran <S-205>, 3-diethylamino-7-m-trifluoromethylanilinofluoran <Black-100>, 3-dibutylamino-7-o-chloroanilinofluoran <TH-107>, 3-(N-cyclohexyl-N-methylamino)-6-methyl-7-anilinofluoran <PSD-150>, 3-diethylamino-7-anilinofluoran <Green-2>,
3,3-bis(4-dimethylaminophenyl)phthalide <MGL>,
tris[4-dimethylamino)phenyl]methane <LCV>,
3,3-bis(1-ethyl-2-methylindole-3-yl)phthalide <Indolyl red>,
3-cyclohexylamino-6-chlorofluoran <OR-55>,
3,3-bis[2-(p-dimethylaminophenyl)-2-(p-methoxyphenyl) ethenyl]-4,5,6,7-tetrachlorophthalide <NIR-Black>,
1,1,5,5-tetrakis(p-dimethylaminophenyl)-3-methoxy-1,4-pentadiene, and
1,1,5,5-tetrakis(p-dimethylaminophenyl)-3-(p-dimethylamino phenyl)-1,4-pentadiene.

As the color developer to be used to the thermal sensitive recording medium of this invention, the conventional well known chemical compounds can be used. The examples of color developer are listed below, however not intended to be limited to them.

Bisphenols such as
2,2-bis(4-hydroxyphenyl)propane,
1,7-di(4-hydroxyphenylthio)-3,5-dioxaheptane and
4,4'-cyclohexilidendiphenol, 4-hydroxy benzoic esters such as
4-hydroxy benzyl benzoate,
4-hydroxy ethyl benzoate,
4-hydroxy normalpropyl benzoate,
4-hydroxy isopropyl benzoate and
4-hydroxy buthyl benzoate, 4-hydroxy phthalic diesters such as
4-hydroxy dimethyl phthalate,
4-hydroxy diisopropyl phthalate and
4-hydroxy dihexyl phthalate, Phthalic monoester such as
monobenzyl phthalate,
monocyclohexyl phthalate,
monophenyl phthalate and
monomethylphenyl phthalate, Bishydroxyphenylsulfides such as
bis(4-hydroxy-3-tert-buthyl-6-methylphenyl)sulfide,
bis(4-hydroxy-2,5-dimethylphenyl)sulfide and
bis(4-hydroxy-2-methyl-5-ethylphenyl)sulfide, 4-hydroxyphenylarylsulfones such as
4-hydroxy-4'-isopropoxydiphenylsulfone,
4-hydroxy-4'-methyldiphenylsulfone and
4-hydroxy-4'-normalpropoxydiphenylsulfone, 4-hydroxyphenylarylsulfonates such as
4-hydroxyphenylbenzenesulfonate,
4-hydroxyphenyl-p-tolylsulfonate and
4-hydroxyphenyl-p-chlorobenzenesulfonate, 1,3-di[2-(hydroxyphenyl)-2-propyl]benzenes such as
1,3-di[2-(4-hydroxyphenyl)-2-propyl]benzene and
1,3-di[2-(4-hydroxy-3-methylphenyl)-2-propyl]benzene, 4-hydroxybenzoiloxibenzoic esters such as
benzyl 4-hydroxybenzoyloxybenzoate,
methyl 4-hydroxybenzoyloxybenzoate,
ethyl 4-hydroxybenzoyloxybenzoate,
normalpropyl 4-hydroxybenzoyloxybenzoate,
isopropyl 4-hydroxybenzoyloxybenzoate and
buthyl 4-hydroxybenzoyloxy benzoate, Bishydroxyphenylsulfones such as
bis(3-tert-buthyl-4-hydroxy-6-methylphenyl)sulfone,
bis(3-ethyl-4-hydroxyphenyl)sulfone,
bis(3-propyl-4-hydroxyphenyl)sulfone,
bis(3-isopropyl-4-hydroxyphenyl)sulfone,
bis(3-ethyl-4-hydroxyphenyl)sulfone
bis(4-hydroxyphenyl)sulfone
2-hydroxyphenyl-4'-hydroxyphenyl)sulfone
bis(3-chloro-4-hydroxyphenyl)sulfone and
bis(3-bromo-4-hydroxyphenyl)sulfone, Phenols such as
p-tert-buthylphenol,
p-phenylphenol,
p-benzylephenol,
1-naphthol and 2-naphthol, Metallic salts of aromatic hydrocarbon such as
benzoic acid,
p-tert-buthyl benzoic acid,
trichloro benzoic acid,
3-sec-buthyl-4-hydroxybenzoic acid,
3-cyclohexyl-4-hydroxybenzoic acid,
3,5-dimethyl-4-hydroxybenzoic acid,
terephthalic acid,
salicylic acid,
3-isopropylsalicylic acid and
3-tert-buthylsalicylic acid N-phenyl-N'-sulfamoylphenylureas such as
N-phenyl-N'-(p-sulfamoyl)phenylurea and
N-phenyl-N'-(m-sulfamoyl)phenylurea, N-phenyl-N'-sulfamoylphenylthioureas such as
N-phenyl-N'-(p-sulfamoyl)phenylthiourea and
N-phenyl-N'-(m-sulfamoyl)phenylthiourea, N-benzenesulfoneyl-phenylureylenebenzamides such as
N-benzenesulfoneyl-p-(phenylureylene)benzamide,
N-(4-toluenesulfoneyl)-p-(phenylureylene)benzamide and
N-(4-ethylphenylsulfoneyl)-p-(phenylureylene)benzamide, and N-benzenesulfoneyl-phenylthioureylenebenzamides such as
N-benzenesulfoneyl-p-(phenylthioureylene)benzamide,
N-(4-toluenesulfoneyl)-p-(phenylthioureylene)benzamide and
N-(4-ethylphenylsulfoneyl)-p-(phenylthioureylene) benzamide.

Among these compounds, bisphenols, 4-hydroxyphenylaryl-sulfones and bishydroxyphenylsulfones are preferably used from the view point of color developing. Especially, since 2,2-bis(4-hydroxyphenyl) propane, 4-hydroxy-4'-isopropoxydiphenylsulfone and bis (4-hydroxyphenyl)sulfone is comparatively cheap and expected effects can be obtained in good balance, they are good for an industrial use.

Generally, in the thermal sensitive recording medium which uses a dye precursor and a color developer as the color developing components, a sensitizer is usually used to improve the color developing sensitivity. The examples of sensitizer are listed below, however not intended to be limited to them. These sensitizers can be used alone or used by mixing together.

Stearic acid, stearamide, palmitic acid amide, oleic acid amide, behenic acid, ethylenebisstearamide, coconut fatty acid amide, montan wax, polyethylene wax,
phenyl-α-naphthylcarbonate,
di-p-tolylcabonate,
diphenylcarbonate,
4-biphenyl-p-tolylether,
p-benzylbiphenyl,
m-terphenyl,
triphenylmethane,
1,1,3-tris(2-methyl-4-hydroxy-5-tert-buthylphenyl)butane,
1,2-bis(3-methylphenoxy)ethane,
1,2-bisphenoxyethane,
1,2-bis(4-methylphenoxy)ethane,
1,4-bisphenoxybutane,
1,4-bisphenoxybutene,
2-naphthylbenzyl ether,
1,4-diethoxynaphthalene,
1,4-methoxynaphthalene,
phenyl 1-hydroxy-2-naphthoate,
methyl 1-hydroxy-2-naphthoate, methyl 1-hydroxy-2-naphthoate,
phenyl 2-naphthoate,
benzyl p-benzyloxybenzoate,
dibenzyl terephthalate,
dimethyl terephthalate,
1,1-phenylethanol,
1,1-diphenyl-2-propanol,
1,3-diphenoxy-2-propanol,
p-(benzyloxy)benzylalcohol,
normaloctadecylcarbamoyl-p-methoxycarbonylbenzene, normaloctadecylcarbamoylbenzene.

In this invention, various stabilizer can be added to improve the stability of recorded image. The examples of stabilizer are listed below, however not intended to be limited to them.

Zinc stearate, aluminum stearate, calcium stearate, zinc palmitate, zinc behenate; metallic salt of p-chlorobenzoic acid (Zn, Ca), metallic salt of monobenzyl phthalate (Zn, Ca) and 4,4'-isopropylidene bis(3-methyl-6-tert-buthyl) phenol.

As a binder used to the thermal sensitive recording medium of this invention, the well known compound can be used. The examples of binders are listed below, however not intended to be limited to them, Full saponificated polyvinylalcohol whose degree of polymerization is smaller than 2000, partially saponificated polyvinylalcohol, carboxy modified polyvinylalcohol, amide modified polyvinylalcohol, sulfonic acid modified polyvinylalcohol, other kind of modified polyvinylalcohol, cellulose derivatives such as hydroxyethylcellulose, methyl cellulose, carboxymethyl cellulose and acetyl cellulose, polymer or co-polymer such as casein, gelatin, styrene/maleic anhydride copolymer, styrene/butadiene copolymer, styrene, vinyl acetate, acrylamide and acrylic acid ester, polyamide resin, silicon resin, petroleum resin, terpene resin, ketone resin, coumarone resin and others. Above mentioned natural and synthetic high molecular compounds are use by dissolving in water or organic solvents such as alcohol, or emulsified or dispersed in an emulsion or a paste-like state. And they can be used alone or in combination.

As a filler to be used in this invention, clay, calcined clay, diatomaceous earth, talc, kaolin, calcium carbonate, basic magnesium carbonate, barium sulfate, barium carbonate, aluminum hydroxide, zinc oxide, silica, magnesium hydroxide, titanium oxide, urea-formaldehyde resin, polystyrene resin, phenol resin and other natural or synthetic, inorganic or organic fillers can be mentioned, however not intended to be limited to them. These fillers can be used alone or used in combination.

In addition to the above, it is further possible to use an ultraviolet ray absorber, a defoaming agent, a fluorescence paint, a water resistance agent and a slip agent as an additive, however not intended to be limited to them.

The amount of dye precursor and color developer, and amount and type of other main components used to the thermal sensitive recording medium of this invention are determined in accordance with the required quality and the recording adaptability and are not specially limited, however it is usually preferable to use 1 to 8 parts of color developer, 1 to 20 parts of fillers to 1 part of dye precursor, and 10 to 25% of binders in an amount of total solid is preferably used.

As a substrate to be used to the thermal sensitive recording medium of this invention, a high quality paper, a middle quality paper, a coated paper, a synthetic paper or a plastic film can be mentioned, however, the present invention is not limited to them.

Further, for the purpose to improve the preservative stability, an overcoat layer composed by high molecular compound can be prepared on the thermal sensitive color developing layer. Furthermore, for the purpose to improve both preservation and sensitivity, an undercoat layer containing an organic or an inorganic filler can be prepared between the color developing layer and the substrate.

EXAMPLES

The Examples for synthesis of poly urea compound used in this invention and the Examples for preparation of thermal sensitive recording medium are illustrated below, however not intended to be limited to the Examples.

Synthesis of the Compound of This Invention

Synthetic Example 1

Synthesis of poly urea compound (A-01) by MDI and 4,4'-diaminodiphenylmethane 3.0 g of 4,4'-diaminodiphenylmethane is dissolved in 20 ml of acetone anhydride. The solution prepared by dissolving 3.75 g of MDI in 20 ml of acetone anhydride is dropped into said solution in nitrogen gas atmosphere. During the dropping the generation of white precipitation is observed. Stirred for 2 hours at room temperature. After the reaction, the obtained fluid is thrown into 500 ml of methanol and the generated precipitation is separated by filtration and rinsed by acetone. Then dried up by a vacuum desiccator and 6.22 g of white solid (A-01) is obtained (yield 92%). The obtained solid is heated and molten at the temperature higher than a decomposition point or a melting point. The confirmation test whether the molten compound indicates a property of spinnability is carried out by sticking a glass bar to the molten compound, by pulling up the bar and by observing the formation of fine filaments. Further, the 0.2 g/dl solution of this compound in 95% concentrated sulfuric acid is prepared and the viscosity of this solution is measured by Canon-Fenske viscometer (Shibata Kagaku Kiki Industries, based on JIS K2283 method) at 25° C. In continued synthetic Examples, the spinnability and viscosity of obtained compound are measured by same procedure. And the spinnability is estimated as follows. That is when the white solid becomes viscous liquid by heating and fine fibers are observed the spinnability is estimated as "good" and when the white solid changes to yellow, brown or black color by heating and smoke is observed, then ash or charcoal remains the spinnability is estimated as "poor".

<Decomposition point>
Higher than 300° C.
<IR spectrum>
(by KBr pellet method, $cm^{-1}$)
3306, 3019, 1649, 1595, 1540, 1508, 1407, 1304, 1229, 1199, 1178, 810, 501
<Spinnability>
poor
<Viscosity>
19.9 mPa's

Synthetic Example 2

Synthesis of poly urea compound (A-02) by MDI and 1,2-ethylenediamine 1.92 g of 1,2-ethylenediamine is dissolved in 52 ml of dimethylformamide. The solution prepared by dissolving 8.0 g of MDI in 100 ml of dimethylformamide is dropped into said solution in nitrogen gas atmosphere. During the dropping the generation of white precipitation is observed. Stirred for 2 hours at room temperature. After the reaction, the obtained fluid is thrown into 500 ml of methanol and the generated precipitation is separated by filtration and rinsed by methanol. Then dried up by vacuum desiccator and 9.70 g of white solid (A-02) is obtained (yield 98%). The confirmation test of spinnability and the measurement of viscosity are carried out same as to the Synthetic Example 1.

<Decomposition point>

290~292° C.

<IR spectrum>

(by KBr pellet method, $cm^{31\ 1}$)

3307, 3111, 3028, 2925, 1639, 1592, 1557, 1542, 1510, 1408, 1305, 1228, 1108, 1017, 864, 817, 771,666,619, 508

<Spinnability> poor

<Viscosity>

20.6 mPa's

Synthetic Example 3

Synthesis of poly urea compound (A-03) by MDI and 1,6-hexamethylenediamine 1.86 g of 1,6-hexamethylenediamine is dissolved in 40 ml of dimethylacetamide. The solution prepared by dissolving 4.00 g of MDI in 40 ml of dimethylacetamide is dropped into said solution in nitrogen gas atmosphere. During the dropping the generation of white precipitation is observed. Stirred for 2 hours at room temperature. After the reaction, the obtained fluid is thrown into 500 ml of methanol and the generated precipitation is separated by filtration and rinsed by acetone. Then dried up by vacuum desiccator and 4.65 g (yield 79%) of white solid (A-03) is obtained. The confirmation test of spinnability and the measurement of viscosity are carried out same as to the Synthetic Example 1.

<Decomposition point>

260~270° C.

<IR spectrum>

(by KBr pellet method, $cm^{-1}$)

3314, 2929, 2851, 1639, 1596, 1541, 1510, 1411, 1307, 1236

<Spinnability> good

<Viscosity>

20.3 mPa's

Synthetic Example 4

Synthesis of poly urea compound (A-04) by MDI and 1,12-dodecanediamine 4.48 g of 1,12-dodecanediamine is dissolved in 120 ml of chloroform. The solution prepared by dissolving 5.6 g of MDI in 70 ml of chloroform is dropped into said solution in nitrogen gas atmosphere. During the dropping the generation of white precipitation is observed. Stirred for 2 hours at room temperature. After the reaction, the obtained fluid is thrown into 500 ml of methanol and the generated precipitation is separated by filtration and rinsed by methanol. Then dried up by vacuum desiccator and 9.18 g (yield 91%) of white solid (A-04) is obtained.

The confirmation test of spinnability and the measurement of viscosity are carried out same as to the Synthetic Example 1.

<Decomposition point>

254~256° C.

<IR spectrum>

(by KBr pellet method, $cm^{-1}$)

3322, 3113, 3031, 2923, 2851, 1650, 1597, 1557, 1511, 1408, 1309, 1231, 1109, 1068, 1018, 814, 773, 720, 652, 508

<Spinnability> good

<Viscosity>

20.9 mPa's

Synthetic Example 5

Synthesis of poly urea compound (A-05) by MDI and 1,2-propanediamine 2.37 g of 1,2-propanediamine is dissolved in 64 ml of dimethylformamide. The solution prepared by dissolving 8.0 g of MDI in 100 ml of dimethylformamide is dropped into said solution in nitrogen gas atmosphere. Stirred for 2 hours at room temperature. After the reaction, the obtained fluid is thrown into 500 ml of methanol and the generated precipitation is separated by filtration and rinsed by methanol. Then dried up by vacuum desiccator and 10.2 g (yield 99%) of white solid (A-05) is obtained.

The confirmation test of spinnability and the measurement of viscosity are carried out same as to the Synthetic Example 1.

<Decomposition point>

274~276° C.

<IR spectrum>

(by KBr pellet method, $cm^{-1}$)

3316, 3115, 3030, 2970, 2925, 1651, 1597, 1544, 1511, 1409, 1312, 1229, 1107, 815, 762, 664, 509

<Spinnability> poor

<Viscosity>

20.3 mPa's

Synthetic Example 6

Synthesis of poly urea compound (A-06) by MDI and 2-methyl-1,5-diaminopentane 2.97 g of 2-methyl-1,5-diaminopentane is dissolved in 80 ml of dimethylformamide. The solution prepared by dissolving 8.0 g of MDI in 100 ml of dimethylformamide is dropped into said solution in nitrogen gas atmosphere. Stirred for 2 hours at room temperature. After the reaction, the obtained fluid is thrown into 500 ml of methanol and the generated precipitation is separated by filtration and rinsed by methanol. Then dried up by vacuum desiccator and 8.41 g (yield 90%) of white solid (A-06) is obtained. The confirmation test of spinnability and the measurement of viscosity are carried out same as to the Synthetic Example 1.

<Decomposition point>

250~270° C.

<IR spectrum>

(by KBr pellet method, $cm^{-1}$)

3378, 3116, 3030, 2925, 2867, 1652, 1598, 1558, 1541, 1508, 1408, 1308, 1229, 1107, 1018, 814, 771, 667, 508

<Spinnability> good

<Viscosity>

20.5 mPa's

Synthetic Example 7

Synthesis of poly urea compound (A-07) by MDI and 1,2-diaminocyclohexane 2.92 g of 1,2-diaminocyclohexane is dissolved in 79 ml of dimethylformamide. The solution prepared by dissolving 6.4 g of MDI in 80 ml of dimethylformamide is dropped into said solution in nitrogen gas atmosphere. During the dropping the generation of small amount of white precipitation is observed. Stirred for 2 hours at room temperature. After the reaction, the obtained fluid is thrown into 500 ml of methanol and the generated precipitation is separated by filtration and rinsed by methanol. Then dried up by vacuum desiccator and 9.03 g (yield 97%) of white solid (A-07) is obtained. The confirmation test of spinnability and the measurement of viscosity are carried out same as to the Synthetic Example 1.

<Decomposition point>
272~280° C.
<IR spectrum>
(by KBr pellet method, $cm^{31\ 1}$)
3320, 3119, 3029, 2930, 2856, 1654, 1599, 1545, 1511, 1409, 1313, 1228, 1109, 814, 761, 662, 509
<Spinnability>
poor
<Viscosity>
20.0 mPa's Synthetic Example 8

Synthesis of poly urea compound (A-08) by MDI and 4,4'-diaminodicyclohexylmethane 4.71 g of 4,4'-diaminodicyclohexylmethane is dissolved in 130 ml of dimethylformamide. The solution prepared by dissolving 5.6 g of MDI in 70 ml of dimethylformamide is dropped into said solution in nitrogen gas atmosphere. Stirred for 2 hours at room temperature. After the reaction, the obtained fluid is thrown into 500 ml of methanol and the generated precipitation is separated by filtration and rinsed by methanol. Then dried up by vacuum desiccator and 10.0 g (yield 97%) of white solid (A-08) is obtained. The confirmation test of spinnability and the measurement of viscosity are carried out same as to the Synthetic Example 1.

<Decomposition point>
285~292° C.
<IR spectrum>
(by KBr pellet method, $cm^{-1}$)
3421, 3030, 2924, 2852, 1654, 1558, 1541, 1520, 1455, 1409, 1316, 1226, 1124, 1036, 818, 762, 659, 507
<Spinnability>
good
<Viscosity>
19.6 mPa's Synthetic Example 9

Synthesis of poly urea compound (A-09) by MDI and ethyleneglycolbis(3-aminopropylether)

3.95 g of ethyleneglycolbis(3-aminopropylether) is dissolved in 100 ml of dimethylformamide. The solution prepared by dissolving 5.60 g of MDI in 70 ml of dimethylformamide is dropped into said solution in nitrogen gas atmosphere. During the dropping the generation of white precipitation is observed. Stirred for 2 hours at room temperature. After the reaction, the obtained fluid is thrown into 500 ml of methanol and the generated precipitation is separated by filtration and rinsed by acetone. Then dried up by vacuum desiccator and 9.40 g (yield 98%) of white solid (A-09) is obtained. The confirmation test of spinnability and the measurement of viscosity are carried out same as to the Synthetic Example 1.

<Decomposition point>
245° C.
<IR spectrum>
(by KBr pellet method, $cm^{-1}$)
3310, 3114, 3046, 3032, 2861, 1650, 1636, 1597, 1558, 1541, 1508, 1407, 1302, 1233, 1104, 1018, 809, 773, 621, 505
<Spinnability>
good
<Viscosity>
21.7 mPa's Synthetic Example 10

Synthesis of poly urea compound (A-10) by MDI and 3,9-bis(3-aminopropyl)-2,4,8,10-tetraoxaspiro[5,5]undecane 5.27 g of 3,9-bis(3-aminopropyl)-2,4,8,10-tetraoxaspiro[5,5]undecane is dissolved in 140 ml of dimethylformamide. The solution prepared by dissolving 4.80 g of MDI in 60 ml of dimethylformamide is dropped into said solution in nitrogen gas atmosphere. Stirred for 2 hours at room temperature. After the reaction, the obtained fluid is thrown into 500 ml of methanol and the generated precipitation is separated by filtration and rinsed by methanol. Then dried up by vacuum desiccator and 9.80 g (yield 97%) of white solid (A-10) is obtained. The confirmation test of spinnability and the measurement of viscosity are carried out same as to the Synthetic Example 1.

<Decomposition point>
240° C.
<IR spectrum>
(by KBr pellet method, $cm^{-1}$)
3387, 2922, 2853, 1653, 1601, 1558, 1541, 1508, 1457, 1408, 1310, 1233, 1167, 1149, 941, 667, 511
<Spinnability>
good
<Viscosity>
19.3 mPa's Synthetic Example 11

Synthesis of poly urea compound (A-11) by MDI and p-xylylenediamine 3.49 g of p-xylylenediamine is dissolved in 90 ml of dimethylformamide. The solution prepared by dissolving 6.40 g of MDI in 80 ml of dimethylformamide is dropped into said solution in nitrogen gas atmosphere. Stirred for 2 hours at the room temperature. After the reaction, the obtained fluid is thrown into 500 ml of methanol and the generated precipitation is separated by filtration and rinsed by acetone. Then dried up by vacuum desiccator and 9.39 g (yield 99%) of white solid (A-11) is obtained. The confirmation test of spinnability and the measurement of viscosity are carried out same as to the Synthetic Example 1.

<Decomposition point>
280° C.
<IR spectrum>
(by KBr pellet method, $cm^{-1}$)
3294, 3121, 3027, 2919, 2875, 1653, 1558, 1541, 1507, 1405, 1302, 1221, 1095, 1052, 1016, 806, 760, 657, 614, 544, 502
<Spinnability>
good
<Viscosity>
19.4 mPa's Synthetic Example 12

Synthesis of poly urea compound (A-12) by MDI and m-phenylenediamine 2.42 g of m-phenylenediamine is dissolved in 65 ml of chloroform. The solution prepared by dissolving 5.61 g of MDI in 70 ml of chloroform is dropped into said solution in nitrogen gas atmosphere. During the dropping the generation of white precipitation is observed. Stirred for 2 hours at the room temperature. After the reaction, the obtained fluid is thrown into 500 ml of methanol,and the generated precipitation is separated by filtration and rinsed by acetone. Then dried up by vacuum desiccator and 7.42 g (yield 92%) of white solid (A-12) is obtained. The confirmation test of spinnability and the measurement of viscosity are carried out same as to the Synthetic Example 1.

<Decomposition point>
higher than 300° C.
<IR spectrum>
(by KBr pellet method, $cm^{-1}$)
3300, 3030, 1646, 1598, 1542, 1512, 1490, 1407, 1302, 1215, 1203, 1107, 1017, 855, 774, 750, 687, 666
<Spinnability>
good
<Viscosity>
21.1 mPa's Synthetic Example 13

Synthesis of poly urea compound (A-13) by MDI and 4,4'-thiodianiline 4.85 g of 4,4'-thiodianiline is dissolved in 130 ml of dimethylformamide. The solution prepared by dissolving 5.60 g of MDI in 70 ml of dimethylformamide is dropped into said solution in nitrogen gas atmosphere. During the dropping the generation of white precipitation is observed. Stirred for 2 hours at room temperature. After the reaction, the obtained fluid is thrown into 500 ml of methanol and the generated precipitation is separated by filtration and rinsed by acetone. Then dried up by vacuum desiccator and 7.29 g (yield 70%) of white solid (A-13) is obtained. The confirmation test of spinnability and the measurement of viscosity are carried out same as to the Synthetic Example 1.

<Decomposition point>
Higher than 300° C.
<IR spectrum>
(by KBr pellet method, $cm^{-1}$)
3301, 3029, 1646, 1592, 1538, 1510, 1491, 1409, 1396, 1306, 1233, 1177, 1107, 1083, 1014, 816, 769, 638, 508
<Spinnability>
poor
<Viscosity>
20.6 mPa's Synthetic Example 14

Synthesis of poly urea compound (A-17) by MDI and 3,3'-diethyl-4,4'-diaminodiphenylmethane 4.07 g of 3,3'-ethyl-4,4'-diaminodiphenylmethane is dissolved in 110 ml of chloroform. The solution prepared by dissolving 4.00 g of MDI in 50 ml of chloroform is dropped into said solution in nitrogen gas atmosphere. During the dropping the generation of white precipitation is observed. Stirred for 2 hours at room temperature. After the reaction, the obtained fluid is thrown into 500 ml of methanol and the generated precipitation is separated by filtration and rinsed by acetone. Then dried up by vacuum desiccator and 8.01 g (yield 99%) of white solid (A-17) is obtained. The confirmation test of spinnability and the measurement of viscosity are carried out same as to the Synthetic Example 1.

<Decomposition point>
270° C.
<IR spectrum>
(by KBr pellet method, $cm^{-1}$)
3286, 3124, 3027, 2962, 2927, 2871, 1653, 1593, 1539, 1507, 1408, 1296, 1238, 1197, 1097, 1056, 1017, 810, 753, 660
<Spinnability>
good
<Viscosity>
22.0 mPa's Synthetic Example 15

Synthesis of poly urea compound (A-18) by MDI and 4,4'-diaminodiphenylthiourea 4.96 g of 4,4'-diaminodiphenylthiourea is dissolved in 130 ml of dimethylacetoamide. The solution prepared by dissolving 4.8 g of MDI in 60 ml of dimethylacetamide is dropped into said solution in nitrogen gas atmosphere. Stirred for 2 hours at room temperature. After the reaction, the obtained fluid is thrown into 500 ml of methanol and the generated precipitation is separated by filtration and rinsed by acetone. Then dried up by vacuum desiccator and 9.70 g (yield 99%) of white solid (A-18) is obtained. The confirmation test of spinnability and the measurement of viscosity are carried out same as to the Synthetic Example 1.

<Decomposition point>
260° C.
<IR spectrum>
(by KBr pellet method, $cm^{-1}$)
3282, 3031, 2927, 1663, 1602, 1507, 1408, 1305, 1227, 1195, 1112, 1015, 829, 745, 718, 508
<Spinnability>
poor
<Viscosity>
22.0 mPa's Synthetic Example 16

Synthesis of poly urea compound (A-21) by 2,4-TDI and 1,6-hexamethylenediamine 2.67 g of 1,6-hexamethylenediamine is dissolved in 40 ml of dimethylformamide. The solution prepared by dissolving 3.29 ml of 2,4-TDI in 40 ml of dimethylformamide is dropped into said solution in nitrogen gas atmosphere. Immediately after the dropping the generation of white precipitation is observed. Stirred for 2 hours at room temperature. After the reaction, the obtained fluid is thrown into 500 ml of methanol and the generated precipitation is separated by filtration and rinsed by acetone. Then dried up by vacuum desiccator and 5.41 g (yield 81%) of white solid (A-21) is obtained. The confirmation test of spinnability and the measurement of viscosity are carried out same as to the Synthetic Example 1.

<Decomposition point>
230~245° C.
<IR spectrum>
(by KBr pellet method, $cm^{-1}$)
3326, 2930, 2856, 1633, 1546, 1446, 1413, 1215, 1011, 649, 591
<Spinnability>
good
<Viscosity>
20.7 mPa's Synthetic Example 17

Synthesis of poly urea compound (A-23) by 2,4-TDI and 4,4'-diaminodiphenylmethane 3.42 g of 4,4'-diaminodiphenylmethane is dissolved in 20 ml of acetone anhydride. The solution prepared by dissolving 2.47 ml of 2,4-TDI in 20 ml of acetone anhydride is dropped into said solution in nitrogen gas atmosphere. Immediately after the dropping the generation of white precipitation is observed. Stirred for 2 hours at room temperature. After the reaction, the obtained fluid is thrown into 500 ml of methanol and the generated precipitation is separated by filtration and rinsed by acetone. Then dried up by vacuum desiccator and 6.14 g (yield 96%) of white solid (A-23) is obtained. The confirmation test of spinnability and the measurement of viscosity are carried out same as to the Synthetic Example 1.

<Decomposition point>
Higher than 300° C.
<IR spectrum>
(by KBr pellet method, $cm^{-1}$)
3293, 2272, 1645, 1596, 1540, 1510, 1409, 1304, 1218, 1203, 810, 662, 507
<Spinnability>
good
<Viscosity>
20.1 mPa's Synthetic Example 18

Synthesis of poly urea compound (A-24) by 2,4-TDI and 4,4'-diaminodiphenylthiourea 4.00 g of 4,4'-diaminodiphenylthiourea is dissolved in 40 ml of dimethylformamide. 2.22 ml of 2,4-TDI is dropped into said solution in nitrogen gas atmosphere. Stirred for 2 hours at room temperature. After the reaction, the obtained fluid is thrown into 500 ml of methanol and the generated precipitation is separated by filtration and rinsed by acetone. Then dried up by vacuum desiccator and 6.65 g (yield 99%) of white solid (A-24) is obtained. The confirmation test of spinnability and the measurement of viscosity are carried out same as to the Synthetic Example 1.

<Decomposition point>
250° C.
<IR spectrum>
(by KBr pellet method, $cm^{-1}$)
3400, 1653, 1607, 1539, 1508, 1407, 1307, 1214, 1125, 1016, 832, 668
<Spinnability>
poor
<Viscosity>
23.0 mPa's Synthetic Example 19

Synthesis of poly urea compound (A-27) by 2,6-TDI and 1,6-hexamethylenediamine 2.67 g of 1,6-hexamethylenediamine is dissolved in 40 ml of dimethylformamide. The solution prepared by dissolving 4.00 g of 2,6-TDI in 40 ml of dimethylformamide is dropped into said solution in nitrogen gas atmosphere. Immediately after the dropping the generation of white precipitation is observed. Stirred for 2 hours at room temperature. After the reaction, the obtained fluid is thrown into 500 ml of methanol and the generated precipitation is separated by filtration and rinsed by acetone. Then dried up by vacuum desiccator and 6.34 g (yield 95%) of white solid (A-27) is obtained. The confirmation test of spinnability and the measurement of viscosity are carried out same as to the Synthetic Example 1.

<Decomposition point>
Higher than 250° C.
<IR spectrum>
(by KBr pellet method, $cm^{-1}$)
3320, 2930, 2857, 1636, 1558, 1472, 1438, 1294, 1241, 1066, 783, 668
<Spinnability>
good
<Viscosity>
20.8 mPa's Synthetic Example 20

Synthesis of poly urea compound (A-31) by HDI and 1,6-hexamethylenediamine 3.45 g of 1,6-hexamethylenediamine is dissolved in 93 ml of methylethylketone. The solution prepared by dissolving 5.00 g of HDI in 63 ml of methylethylketone is dropped into said solution in nitrogen gas atmosphere. Immediately after the dropping the generation of white precipitation is observed. Stirred for 1 hours at room temperature. After the reaction, the obtained fluid is thrown into 400 ml of methanol and the generated precipitation is separated by filtration and rinsed by acetone. Then dried up by vacuum desiccator and 5.32 g (yield 63%) of white solid (A-31) is obtained. The confirmation test of spinnability and the measurement of viscosity are carried out same as to the Synthetic Example 1.

<Decomposition point>
274~276° C.
<IR spectrum>
(by KBr pellet method, $cm^{-1}$)
3358, 3136, 2933, 2856, 1628, 1571, 1477, 1461, 1251, 1214, 1074, 625, 603
<Spinnability>
good
<Viscosity>
20.2 mPa's Synthetic Example 21

Synthesis of poly urea compound (A-39) by HDI and 4,4'-diaminobenzanilide 4.05 g of 4,4'-diaminobenzanilide is dissolved in 110 ml of methylethylketone. The solution prepared by dissolving 3.00 g of HDI in 40 ml of methylethylketone is dropped into said solution in nitrogen gas atmosphere. Immediately after the dropping the generation of white precipitation is observed. Stirred for 1 hours at room temperature. After the reaction, the obtained fluid is thrown into 400 ml of methanol and the generated precipitation is separated by filtration and rinsed by acetone. Then dried up by vacuum desiccator and 4.73 g (yield 67%) of white solid (A-39) is obtained. The confirmation test of spinnability and the measurement of viscosity are carried out same as to the Synthetic Example 1.

<Decomposition point>
Higher than 300° C.
<IR spectrum>
(by KBr pellet method, $cm^{-1}$)
3310, 2930, 2856, 1641, 1607, 1556, 1512, 1403, 1309, 1231, 1181, 1109, 835, 761, 666, 636, 523
<Spinnability>
good
<Viscosity>
20.0 mPa's Synthetic Example 22

Synthesis of poly urea compound (A-44) by NDI and 1,6-hexamethylenediamine 2.64 g 1,6-hexamethylenediamine of is dissolved in 71 ml of methylethylketone. The solution prepared by dissolving 5.04 g of NDI in 63 ml of methylethylketone is dropped into said solution in nitrogen gas atmosphere. Immediately after the dropping the generation of white precipitation is observed. Stirred for 1 hours at room temperature. After the reaction, the obtained fluid is thrown into 400 ml of methanol and the generated precipitation is separated by filtration and rinsed by acetone. Then dried up by vacuum desiccator and 5.99 g (yield 77%) of white solid (A-44) is obtained. The confirmation test of spinnability and the measurement of viscosity are carried out same as to the Synthetic Example 1.

<Decomposition point>
Higher than 300° C.
<IR spectrum>
(by KBr pellet method, $cm^{-1}$)
3315, 3114, 3069, 2929, 2856, 1634, 1558, 1543, 1418, 1329, 1239, 779, 668
<Spinnability>
poor
<Viscosity>
20.2 mPa's Synthetic Example 23

Synthesis of poly urea compound (A-57) by isopholonediisocyanate and m-phenylenediamine 2.43 g of m-phenylenediamine is dissolved in 66 ml of methylethylketone. The solution prepared by dissolving 5.00 g of isopholonediisocyanate in 63 ml of methylethylketone is dropped into said solution in nitrogen gas atmosphere. Stirred for 1 hours at room temperature. After the reaction, the obtained fluid is thrown into 400 ml of methanol and the generated precipitation is separated by filtration and rinsed by acetone. Then dried up by vacuum desiccator and 2.87 g (yield 39%) of white solid (A-57) is obtained. The confirmation test of spinnability and the measurement of viscosity are carried out same as to the Synthetic Example 1.

<Decomposition point>
287~290° C.
<IR spectrum>
(by KBr pellet method, $cm^{-1}$)
3376, 2951, 2916, 1656, 1606, 1543, 1490, 1304, 1228, 866, 777, 690
<Spinnability>
good
<Viscosity>
20.2 mPa's Synthetic Example 24

Synthesis of poly urea compound (A-71) by dicyclohexylmethane-4,4'-diisocyanate and 2,4-diaminotoluene 4.01 g of 2,4-diaminotoluene is dissolved in 108 ml of methylethylketone. The solution prepared by dissolving 6.03 g of dicyclohexylmethane-4,4'-diisocyanate in 75 ml of methylethylketone is dropped into said solution in nitrogen gas atmosphere. Immediately after the dropping the generation of white precipitation is observed. Stirred for 1 hour at room temperature. After the reaction, the obtained fluid is thrown into 400 ml of methanol and the generated precipitation is separated by filtration and rinsed by acetone. Then dried up by vacuum desiccator and 5.50 g (yield 62%) of white solid (A-71) is obtained. The confirmation test of spinnability and the measurement of viscosity are carried out same as to the Synthetic Example 1.

<Decomposition point>
283~290° C.
<IR spectrum>
(by KBr pellet method, $cm^{-1}$)
3344, 2923, 2851, 1647, 1596, 1538, 1448, 1413, 1377, 1308, 1275, 1222, 1129, 894, 812, 663
<Spinnability>
good
<Viscosity>
19.4 mPa's

TABLE 1

Test results of viscosity and spinnability of Synthetic Examples

| Synthetic Example | viscosity | spinnability |
|---|---|---|
| 1 | 19.9 | X (poor) |
| 2 | 20.6 | X |
| 3 | 20.3 | ○(good) |
| 4 | 20.9 | ○ |
| 5 | 20.3 | X |
| 6 | 20.5 | ○ |
| 7 | 20.0 | X |
| 8 | 19.6 | ○ |
| 9 | 21.7 | ○ |
| 10 | 19.3 | ○ |
| 11 | 19.4 | ○ |
| 12 | 21.1 | ○ |
| 13 | 20.6 | X |
| 14 | 22.0 | ○ |
| 15 | 22.0 | X |
| 16 | 20.7 | ○ |
| 17 | 20.1 | ○ |
| 18 | 23.0 | X |
| 19 | 20.8 | ○ |
| 20 | 20.2 | ○ |
| 21 | 20.0 | ○ |
| 22 | 20.2 | X |
| 23 | 20.2 | ○ |
| 24 | 19.4 | ○ |

Fabrication of Thermal Sensitive Recording Medium

Examples 1~48

The thermal sensitive recording medium composed by following components are fabricated. As the first step, a dye dispersion (liquid A), a color developer dispersion (liquid B) and a poly urea dispersion (liquid C) are separately ground to average particles diameter of 1 $\mu$m by a sand grinder.

| | |
|---|---|
| (liquid A: dispersion of dye) | |
| 3-N,N-diethylamino-6-methyl-7-anilinofluoran | 2.0 parts |
| 10% aqueous solution of polyvinyl alcohol | 4.6 parts |
| water | 2.6 parts |
| (liquid B: dispersion of color developer) | |
| color developer (refer to Table I) | 6.0 parts |
| 10% aqueous solution of polyvinyl alcohol | 18.8 parts |
| water | 11.2 parts |
| (liquid C: dispersion of poly urea) | |
| compound of this invention (refer to Table 1) | 4.0 parts |
| 10% aqueous solution of polyvinyl alcohol | 12.5 parts |
| water | 7.5 parts |

Then, a thermal sensitive coating is prepared by mixing liquid A, liquid B, liquid C and a dispersion of kaolin clay by following combination ratio.

| | |
|---|---|
| Liquid A: dispersion of dye | 9.2 parts |
| Liquid B: dispersion of color developer | 36.0 parts |
| Liquid C: dispersion of poly urea | 24.0 parts |
| Kaolin clay (50% aqueous dispersion) | 12.0 parts |

The prepared thermal sensitive coating is coated over the one side surface of 50 g/m$^2$ base paper, dried and super calendered to a flatness of 500 to 600 seconds to obtain a thermal sensitive recording medium with a coating amount of 6.0 to 6.5 g/m2.

In above explanations, parts and % respectively indicate parts by weight and weight %.

Comparative Examples 1~2

A thermal sensitive coating without (liquid C: dispersion of poly urea) is prepared, and thermal sensitive recording media are prepared by the same procedure as in Examples 1~48.

Evaluation Methods of the Thermal Sensitive Recording Media

Method for Color Developing

Thermal recording is carried out on the prepared thermal sensitive recording media using an UBI Printer 201 (UBI) at an application energy of 450 mj/mm$^2$. Then the recording density of recording part and blank part are measured by a Macbeth densitometer (RD-914, amber filter used). Following tests are carried out on the specimen obtained as above.

[Plasticizer resistance test]: Specimen for test is contacted to a polyvinylchloride film (DIAWRAP 300G, product of Mitsubishi Resin), allowed to leave alone for 4 hours at 40° C. and the density of recorded part is measured by a Macbeth densitometer.

[Oil resistance test]: Specimen for test is dipped into salad oil for 1 hour, then wiped off, allowed to leave alone for 24 hours in room temperature and the density of recorded part is measured by a Macbeth densitometer.

[Water resistance test]: Specimen for test is dipped into city water for 24 hours, dried at 30° C. for 2 hours then the density of recorded part is measured by a Macbeth densitometer.

The combination ratio of image preservative stability tests are summarized in Table 2 and the obtained results are shown in Table 3. In Table 3, the bigger value of Macbeth densitometer indicates good image preservative stability.

TABLE 2 - 1

| combination of image preservative stability test | | |
|---|---|---|
| No. | color developer | compound of this invention |
| Ex. 1 | 4-hydroxy-4'-isopropoxydiphenyl sulfone | A-01 |
| Ex. 2 | 2,2-bis(4-hydroxyphenyl) propane | A-01 |
| Ex. 3 | 4-hydroxy-4'-isopropoxydiphenyl sulfone | A-02 |
| Ex. 4 | 2,2-bis(4-hydroxyphenyl) propane | A-02 |
| Ex. 5 | 4-hydroxy-4'-isopropoxydiphenyl sulfone | A-03 |
| Ex. 6 | 2,2-bis(4-hydroxyphenyl) propane | A-03 |
| Ex. 7 | 4-hydroxy-4'-isopropoxydiphenyl sulfone | A-04 |
| Ex. 8 | 2,2-bis(4-hydroxyphenyl) propane | A-04 |
| Ex. 9 | 4-hydroxy-4'-isopropoxydiphenyl sulfone | A-05 |
| Ex. 10 | 2,2-bis(4-hydroxyphenyl) propane | A-05 |

TABLE 2 - 1-continued

| combination of image preservative stability test | | |
|---|---|---|
| No. | color developer | compound of this invention |
| Ex. 11 | 4-hydroxy-4'-isopropoxydiphenyl sulfone | A-06 |
| Ex. 12 | 2,2-bis(4-hydroxyphenyl) propane | A-06 |

TABLE 2 - 2

| combination of image preservative stability test | | |
|---|---|---|
| No. | color developer | compound of this invention |
| Ex. 13 | 4-hydroxy-4'-isopropoxydiphenyl sulfone | A-07 |
| Ex. 14 | 2,2-bis(4-hydroxyphenyl) propane | A-07 |
| Ex. 15 | 4-hydroxy-4'-isopropoxydiphenyl sulfone | A-08 |
| Ex. 16 | 2,2-bis(4-hydroxyphenyl) propane | A-08 |
| Ex. 17 | 4-hydroxy-4'-isopropoxydiphenyl sulfone | A-09 |
| Ex. 18 | 2,2-bis(4-hydroxyphenyl) propane | A-09 |
| Ex. 19 | 4-hydroxy-4'-isopropoxydiphenyl sulfone | A-10 |
| Ex. 20 | 2,2-bis(4-hydroxyphenyl) propane | A-10 |
| Ex. 21 | 4-hydroxy-4'-isopropoxydiphenyl sulfone | A-11 |
| Ex. 22 | 2,2-bis(4-hydroxyphenyl) propane | A-11 |
| Ex. 23 | 4-hydroxy-4'-isopropoxydiphenyl sulfone | A-12 |
| Ex. 24 | 2,2-bis(4-hydroxyphenyl) propane | A-12 |

TABLE 2 - 3

| combination of image preservative stability test | | |
|---|---|---|
| No. | color developer | compound of this invention |
| Ex. 25 | 4-hydroxy-4'-isopropoxydiphenyl sulfone | A-13 |
| Ex. 26 | 2,2-bis(4-hydroxyphenyl) propane | A-13 |
| Ex. 27 | 4-hydroxy-4'-isopropoxydiphenyl sulfone | A-17 |
| Ex. 28 | 2,2-bis(4-hydroxyphenyl) propane | A-17 |
| Ex. 29 | 4-hydroxy-4'-isopropoxydiphenyl sulfone | A-18 |
| Ex. 30 | 2,2-bis(4-hydroxyphenyl) propane | A-18 |
| Ex. 31 | 4-hydroxy-4'-isopropoxydiphenyl sulfone | A-21 |
| Ex. 32 | 2,2-bis(4-hydroxyphenyl) propane | A-21 |
| Ex. 33 | 4-hydroxy-4'-isopropoxydiphenyl sulfone | A-23 |
| Ex. 34 | 2,2-bis(4-hydroxyphenyl) propane | A-23 |
| Ex. 35 | 4-hydroxy-4'-isopropoxydiphenyl sulfone | A-24 |
| Ex. 36 | 2,2-bis(4-hydroxyphenyl) propane | A-24 |

TABLE 2 - 4

| combination of image preservative stability test | | |
|---|---|---|
| No. | color developer | compound of this invention |
| Ex. 37 | 4-hydroxy-4'-isopropoxydiphenyl sulfone | A-27 |
| Ex. 38 | 2,2-bis(4-hydroxyphenyl) propane | A-27 |

TABLE 2 - 4-continued combination of image preservative stability test

| No. | color developer | compound of this invention |
|---|---|---|
| Ex. 39 | 4-hydroxy-4'-isopropoxydiphenyl sulfone | A-31 |
| Ex. 40 | 2,2-bis(4-hydroxyphenyl) propane | A-31 |
| Ex. 41 | 4-hydroxy-4'-isopropoxydiphenyl sulfone | A-39 |
| Ex. 42 | 2,2-bis(4-hydroxyphenyl) propane | A-39 |
| Ex. 43 | 4-hydroxy-4'-isopropoxydiphenyl sulfone | A-44 |
| Ex. 44 | 2,2-bis(4-hydroxyphenyl) propane | A-44 |
| Ex. 45 | 4-hydroxy-4'-isopropoxydiphenyl sulfone | A-57 |
| Ex. 46 | 2,2-bis(4-hydroxyphenyl) propane | A-57 |
| Ex. 47 | 4-hydroxy-4'-isopropoxydiphenyl sulfone | A-71 |
| Ex. 48 | 2,2-bis(4-hydroxyphenyl) propane | A-71 |
| Compar. Ex. 1 | 4-hydroxy-4'-isopropoxydiphenyl sulfone | none |
| Compar. Ex. 2 | 2,2-bis(4-hydroxyphenyl) propane | none |

TABLE 3 - 1

Test results of image preservation stability test

| No. | color density | plasticiser resistance | oil resistance | water resistance |
|---|---|---|---|---|
| Example 1 | 1.39 | 1.25 | 1.10 | 1.29 |
| Example 2 | 1.36 | 1.23 | 1.09 | 1.29 |
| Example 3 | 1.35 | 1.20 | 1.10 | 1.25 |
| Example 4 | 1.32 | 1.18 | 1.10 | 1.22 |
| Example 5 | 1.34 | 1.29 | 1.14 | 1.22 |
| Example 6 | 1.33 | 1.29 | 1.15 | 1.21 |
| Example 7 | 1.32 | 1.25 | 1.10 | 1.15 |
| Example 8 | 1.30 | 1.25 | 1.11 | 1.10 |
| Example 9 | 1.30 | 1.20 | 1.11 | 1.16 |
| Example 10 | 1.24 | 1.13 | 1.05 | 1.09 |
| Example 11 | 1.29 | 1.18 | 1.12 | 1.12 |
| Example 12 | 1.28 | 1.11 | 1.09 | 1.13 |
| Example 13 | 1.25 | 1.15 | 1.04 | 1.10 |
| Example 14 | 1.25 | 1.15 | 1.03 | 1.10 |
| Example 15 | 1.19 | 1.02 | 1.01 | 1.11 |
| Example 16 | 1.18 | 1.00 | 0.98 | 1.08 |
| Example 17 | 1.26 | 1.20 | 1.12 | 1.15 |
| Example 18 | 1.27 | 1.21 | 1.10 | 1.13 |
| Example 19 | 1.18 | 1.01 | 1.08 | 1.10 |
| Example 20 | 1.18 | 0.98 | 1.05 | 1.10 |
| Example 21 | 1.10 | 1.00 | 1.00 | 1.10 |
| Example 22 | 1.09 | 1.01 | 0.99 | 1.03 |
| Example 23 | 1.16 | 1.05 | 1.09 | 1.12 |
| Example 24 | 1.10 | 0.99 | 1.01 | 1.03 |

TABLE 3 - 2

Test results of image preservation stability test

| No. | color density | plasticiser resistance | oil resistance | water resistance |
|---|---|---|---|---|
| Example 25 | 1.33 | 1.28 | 1.10 | 1.21 |
| Example 26 | 1.33 | 1.27 | 1.09 | 1.22 |
| Example 27 | 1.38 | 1.22 | 1.08 | 1.20 |
| Example 28 | 1.31 | 1.20 | 1.09 | 1.21 |
| Example 29 | 1.33 | 1.15 | 1.01 | 1.18 |
| Example 30 | 1.33 | 1.14 | 1.06 | 1.20 |
| Example 31 | 1.12 | 1.12 | 1.01 | 1.10 |
| Example 32 | 1.08 | 1.00 | 1.01 | 1.04 |
| Example 33 | 1.27 | 1.10 | 1.09 | 1.16 |
| Example 34 | 1.20 | 1.05 | 1.03 | 1.10 |

TABLE 3 - 2-continued

Test results of image preservation stability test

| No. | color density | plasticiser resistance | oil resistance | water resistance |
|---|---|---|---|---|
| Example 35 | 1.33 | 1.14 | 1.05 | 1.15 |
| Example 36 | 1.33 | 1.12 | 1.05 | 1.13 |
| Example 37 | 1.12 | 1.08 | 1.01 | 1.10 |
| Example 38 | 1.09 | 1.01 | 1.00 | 1.01 |
| Example 39 | 0.91 | 0.81 | 0.85 | 0.88 |
| Example 40 | 0.87 | 0.80 | 0.82 | 0.83 |
| Example 41 | 1.31 | 1.20 | 1.09 | 1.22 |
| Example 42 | 1.29 | 1.17 | 1.10 | 1.18 |
| Example 43 | 1.17 | 1.03 | 1.01 | 1.10 |
| Example 44 | 1.12 | 1.01 | 0.98 | 1.04 |
| Example 45 | 1.16 | 1.05 | 1.01 | 1.10 |
| Example 46 | 1.11 | 1.04 | 1.00 | 1.08 |
| Example 47 | 0.99 | 0.83 | 0.86 | 0.91 |
| Example 48 | 0.97 | 0.81 | 0.81 | 0.90 |
| Compar. Example 1 | 1.46 | 0.36 | 0.23 | 1.24 |
| Compar. Example 2 | 1.41 | 0.38 | 0.33 | 1.02 |

As clearly shown from these results, Examples 1~48 which contain poly urea compound of this invention in a color developing layer, are superior to Comparative Examples 1~2 which do not contain poly urea compound at the image preservative stability of recording part.

EFFECT OF THE INVENTION

Since the thermal sensitive recording medium which contains the poly urea compound of this invention in thermal sensitive color developing layer is superior at image preservative stability of recording part and can be produced by low price, it can be said as a very useful and convenient recording medium.

We claim:

1. A thermally sensitive recording medium comprising a thermally sensitive color developing layer which comprises (a) a colorless or pale colored dye precursor, (b) a color developer which can react with the dye precursor to develop a color when heated and (c) a polyurea compound which comprises units of formula (1):

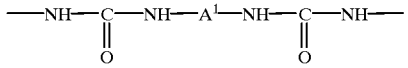

(1)

wherein $A^1$ represents a divalent group of one of the following formulae:

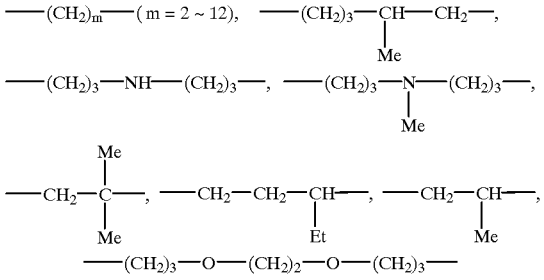

-continued
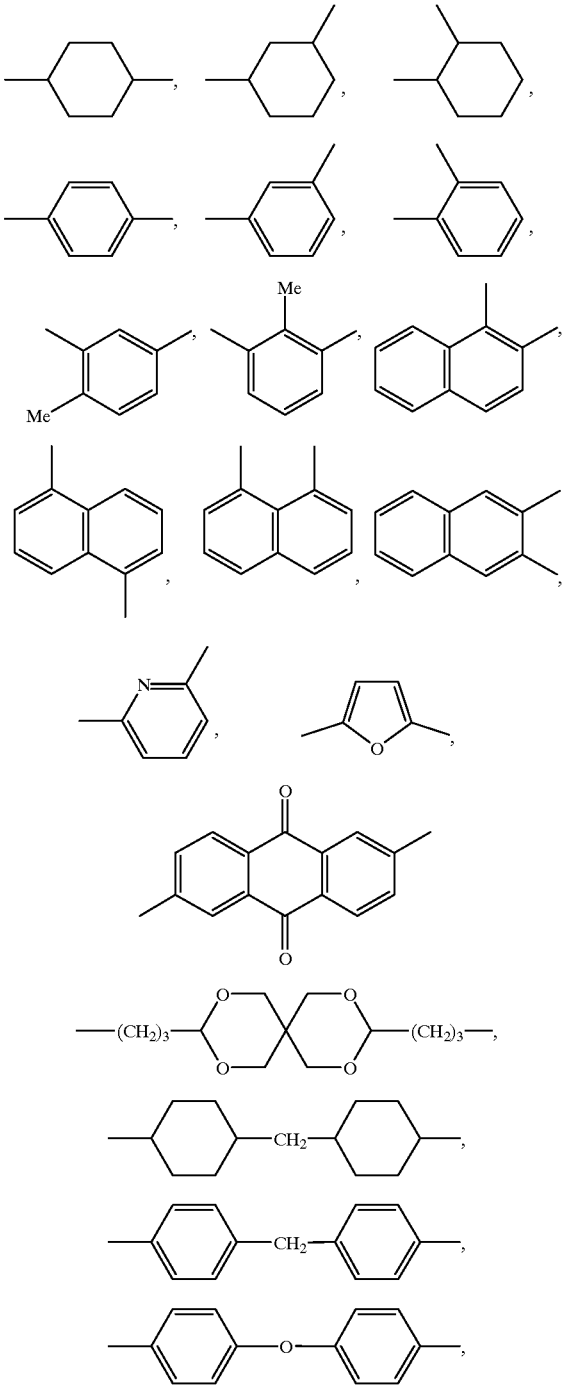
-continued
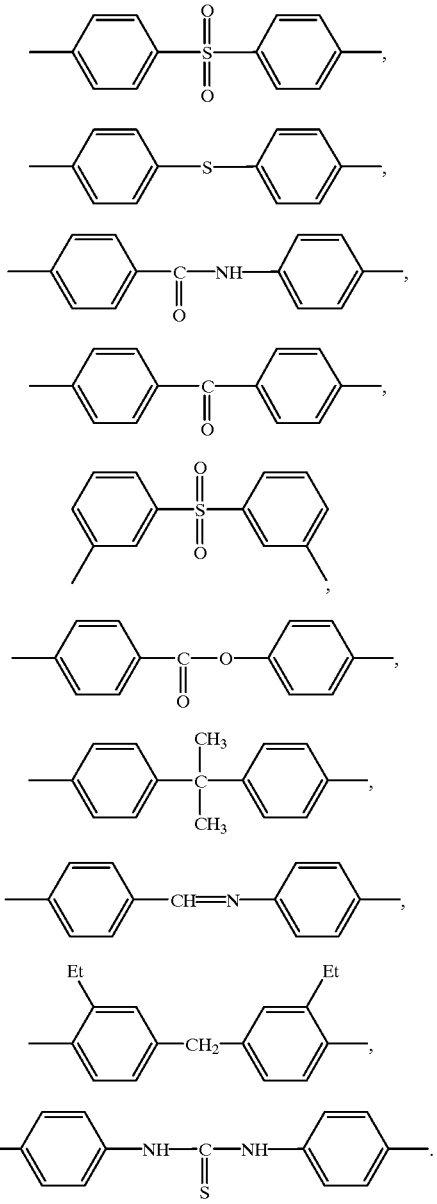
2. The medium according to claim 1, wherein the polyurea compound comprises units of formula (2);
(2)
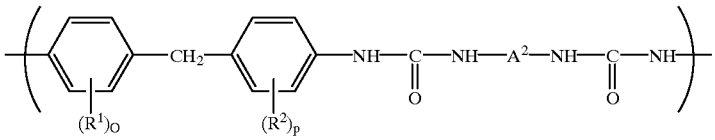

wherein $R^1$ and $R^2$ each represent an alkyl group, an alkoxy group or an electron accepting group, o and p are each an integer from 0 to 4 and $A^2$ represents a divalent group as defined for $A^1$ in claim 10.

3. The medium according to claim 1, wherein the polyurea compound comprises units of formula (3):

(3)

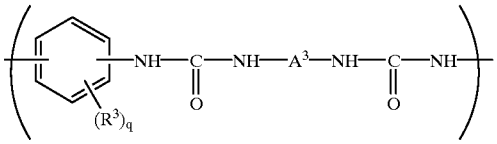

wherein $R^3$ represents an alkyl group, an alkoxy group or an electron accepting group, q is an integer from 0 to 4 and $A^3$ represents a divalent group as defined for $A^1$ in claim 10.

4. The medium according to claims 1, wherein the polyurea compound comprises units of formula (4):

(4)

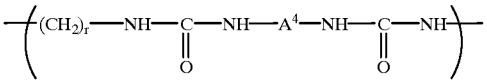

wherein r is an integer from 2 to 12 and $A^4$ represents a divalent group as defined for $A^1$ in claim 10.

5. The medium according to claim 1, wherein the polyurea compound comprises units of formula (5):

(5)

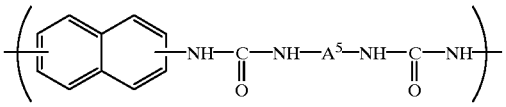

wherein $A^5$ represents a divalent group as defined for $A^1$ in claim 10.

6. The medium according to claim 1, wherein the polyurea compound comprises units of formula (6):

(6)

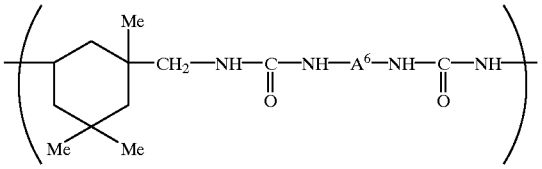

wherein $A^6$ represents a divalent group as defined for $A^1$ in claim 10.

7. The medium according to claim 1, wherein the polyurea compound comprises units of formula (7):

(7)

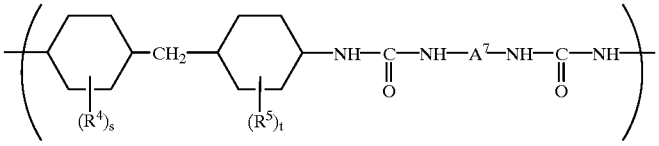

wherein $R^4$ and $R^5$ each represent an alkyl group, an alkoxy group or an electron accepting group, s and t are each an integer from 0 to 8 and $A^7$ represents a divalent group as defined for $A^1$ in claim 10.

8. The medium according to any one of claims 1 to 7, wherein the content of polyurea compound is from 0.01 to 2 parts per 1 part color developer.

* * * * *